US007298347B2

(12) United States Patent
Yamazaki et al.

(10) Patent No.: US 7,298,347 B2
(45) Date of Patent: Nov. 20, 2007

(54) DISPLAY DEVICE

(75) Inventors: Shunpei Yamazaki, Tokyo (JP); Jun Koyama, Kanagawa (JP); Kazue Hosoki, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 132 days.

(21) Appl. No.: 10/347,241

(22) Filed: Jan. 21, 2003

(65) Prior Publication Data

US 2003/0132716 A1 Jul. 17, 2003

Related U.S. Application Data

(62) Division of application No. 09/878,312, filed on Jun. 12, 2001, now Pat. No. 6,528,951.

(30) Foreign Application Priority Data

Jun. 13, 2000 (JP) ..... 2000-176246

(51) Int. Cl.
*G09G 3/14* (2006.01)

(52) U.S. Cl. ..... 345/46; 345/92; 315/169.3

(58) Field of Classification Search .. 315/169.1–169.4; 345/34–38, 76–84, 45, 92–94, 98–100
See application file for complete search history.

(56) References Cited

U.S. PATENT DOCUMENTS 4,308,556 A 12/1981 Osaka ..... 380/235
5,247,190 A 9/1993 Friend et al. ..... 438/22
5,399,502 A 3/1995 Friend et al. ..... 257/40
5,594,463 A 1/1997 Sakamoto ..... 345/76
5,597,223 A 1/1997 Watanabe et al. ..... 353/97
5,745,085 A 4/1998 Tomio et al. ..... 345/63

(Continued)

FOREIGN PATENT DOCUMENTS

CN 1318818 10/2001

(Continued)

OTHER PUBLICATIONS

Ronald J. Tocci. Fundamentals of Electronic Devices 2nd edition in 1975. Charles E. Merrill Publishing Co. pp. 228-229.*

(Continued)

*Primary Examiner*—Wilson Lee
(74) *Attorney, Agent, or Firm*—Fish & Richardson P.C.

(57) ABSTRACT

The image quality of a display device using a bottom gate TFT is improved. In particular, fluctuation in luminance is controlled and the frequency characteristic of a driver circuit is compensated by suppressing a change in amount of current flowing through an EL element which is caused by a change in surrounding temperature while the device is in use. A monitoring EL element is provided in addition to a pixel portion EL element. The monitoring EL element constitutes a temperature compensation circuit together with a buffer amplifier and the like. A current is supplied to the pixel portion EL element through the temperature compensation circuit. This makes it possible to keep the amount of current flowing through the pixel portion EL element constant against a change in temperature, and to control the fluctuation in luminance. An input signal is subjected to time base expansion to perform sampling with accuracy.

29 Claims, 25 Drawing Sheets

U.S. PATENT DOCUMENTS

| | | | | |
|---|---|---|---|---|
| 5,844,535 | A | 12/1998 | Itoh et al. | 345/92 |
| 5,882,761 | A | 3/1999 | Kawami et al. | 428/69 |
| 5,886,474 | A | 3/1999 | Asai et al. | 315/169.1 |
| 5,893,730 | A | 4/1999 | Yamazaki et al. | 438/166 |
| 5,990,629 | A | 11/1999 | Yamada et al. | 315/169.3 |
| 5,999,242 | A * | 12/1999 | Walton et al. | 345/97 |
| 6,002,385 | A * | 12/1999 | Silverbrook | 345/100 |
| 6,005,350 | A | 12/1999 | Hachiya et al. | 315/156 |
| 6,049,321 | A | 4/2000 | Sasaki | 345/99 |
| 6,054,976 | A * | 4/2000 | Kubota et al. | 345/100 |
| 6,069,676 | A | 5/2000 | Yuyama | 349/62 |
| 6,072,448 | A | 6/2000 | Kojima et al. | 345/63 |
| 6,097,302 | A * | 8/2000 | Zinzell | 345/34 |
| 6,147,451 | A | 11/2000 | Shibata et al. | 313/506 |
| 6,219,113 | B1 * | 4/2001 | Takahara | 349/45 |
| 6,320,325 | B1 | 11/2001 | Cok et al. | 315/169.3 |
| 6,335,713 | B1 | 1/2002 | Imai | 345/76 |
| 6,373,459 | B1 | 4/2002 | Jeong | 345/100 |
| 6,376,994 | B1 * | 4/2002 | Ochi et al. | 315/169.1 |
| 6,380,558 | B1 | 4/2002 | Yamazaki et al. | 257/57 |
| 6,392,617 | B1 | 5/2002 | Gleason | 345/82 |
| 6,396,468 | B2 | 5/2002 | Matsushima et al. | 345/87 |
| 6,396,508 | B1 | 5/2002 | Noecker | 345/693 |
| 6,404,137 | B1 | 6/2002 | Shodo | 315/169.1 |
| 6,411,306 | B1 | 6/2002 | Miller et al. | 345/690 |
| 6,414,661 | B1 | 7/2002 | Shen et al. | 345/82 |
| 6,417,824 | B1 | 7/2002 | Tokunaga et al. | 345/60 |
| 6,424,326 | B2 | 7/2002 | Yamazaki et al. | 345/77 |
| 6,452,576 | B1 * | 9/2002 | Van Velzen et al. | 345/82 |
| 6,486,862 | B1 | 11/2002 | Jacobsen et al. | 345/88 |
| 6,496,218 | B2 | 12/2002 | Takigawa et al. | 348/42 |
| 6,518,941 | B1 | 2/2003 | Kimura | 345/55 |
| 6,518,962 | B2 | 2/2003 | Kimura et al. | 345/211 |
| 6,525,704 | B1 | 2/2003 | Kondo et al. | 345/78 |
| 6,528,951 | B2 | 3/2003 | Yamazaki et al. | 315/169.3 |
| 6,534,925 | B2 | 3/2003 | Kawashima | 315/169.1 |
| 6,552,736 | B2 | 4/2003 | Honda et al. | 345/691 |
| 6,677,936 | B2 * | 1/2004 | Jacobsen et al. | 345/88 |
| 6,816,144 | B2 | 11/2004 | Tsuchi | 345/100 |
| 2001/0017618 | A1 | 8/2001 | Azami | 345/204 |
| 2001/0026257 | A1 | 10/2001 | Kimura | 345/87 |
| 2001/0033252 | A1 | 10/2001 | Yamazaki et al. | 345/7 |
| 2002/0053884 | A1 | 5/2002 | Kimura | 315/169.3 |
| 2002/0145602 | A1 | 10/2002 | Matsueda | 345/213 |
| 2002/0154151 | A1 | 10/2002 | Koyama | 345/690 |
| 2002/0180672 | A1 | 12/2002 | Yamazaki et al. | 345/77 |
| 2002/0180721 | A1 | 12/2002 | Kimura et al. | 345/211 |
| 2003/0063081 | A1 | 4/2003 | Kimura et al. | 345/211 |
| 2003/0132716 | A1 | 7/2003 | Yamazaki et al. | 315/169.3 |
| 2005/0012731 | A1 | 1/2005 | Yamazaki et al. | 345/204 |
| 2005/0017963 | A1 | 1/2005 | Yamazaki et al. | 345/204 |
| 2005/0017964 | A1 | 1/2005 | Yamazaki et al. | 345/204 |

FOREIGN PATENT DOCUMENTS

| | | |
|---|---|---|
| EP | 0 923 067 | 6/1999 |
| JP | 01-92576 | 4/1989 |
| JP | 10-092576 | 4/1989 |
| JP | 05-094151 | 4/1993 |
| JP | 07-036410 | 2/1995 |
| JP | 09-148066 | 6/1997 |
| JP | 10-092576 | 4/1998 |
| JP | 10-214060 | 8/1998 |
| JP | 10-232649 | 9/1998 |
| JP | 11-272223 | 10/1999 |
| JP | 11-273856 | 10/1999 |
| JP | 2001-109433 | 4/2001 |
| TW | 250560 | 7/1995 |
| WO | WO90-13148 | 11/1990 |
| WO | WO90/13148 | 11/1990 |
| WO | WO98-40871 | 9/1998 |
| WO | WO01-27910 | 4/2001 |

OTHER PUBLICATIONS

H. Shenk et al.; "Polymers for Light-Emitting Diodes"; *Euro Display Proceedings*; pp. 33-37; 1999.

Schenk et al., "Polymers for Light Emitting Diodes", EuroDisplay '99, The 19th International Display Research Conference, pp. 33-37, Berlin, Germany, Sep. 6, 1999.

Mizukami et al., "6-Bit Digital VGA OLED," *SID* '00 Digest, pp. 912-915, 2000.

Dawson et al., "Design of an Improved Pixel for a Polysilicon Active-Matrix Organic LED Display," *SID* '98 Digest, pp. 11-14, 1998.

* cited by examiner

T1 > T2 > T3

DISPLAY DEVICE

CROSS-REFERENCE TO RELATED APPLICATION

This application is a divisional of U.S. application Ser. No. 09/878,312, filed Jun. 12, 2001 now U.S. Pat. No. 6,528,951, which is incorporated by reference.

BACKGROUND OF THE INVENTION

1. Field of the Invention

The present invention relates to an electronic display device fabricated by forming EL (electroluminescence) elements on a substrate, specifically, to an EL display device using a semiconductor element (an element formed from a semiconductor thin film). The invention also relates to electronic equipment employing the EL display device as a display unit.

The EL element herein includes both an element that utilizes light emission from a singlet exciton (fluorescence) and an element that utilizes light emission from a triplet exciton (phosphorescence).

2. Description of the Related Art

Development of EL display devices having an EL element as a self-luminous element is flourishing in recent years. The EL display devices are also called organic EL displays (OELDS) or organic light emitting diodes (OLEDs).

The EL display devices are self-luminous unlike liquid crystal display devices. The EL element is structured such that an EL layer is sandwiched between a pair of electrodes (an anode and a cathode). The EL layer usually has a laminate structure. Typical example thereof is a laminate structure consisting of a hole transportation layer, a light emitting layer and an electron transportation layer which has been proposed by Tang, et al. of Eastman Kodak Company. This structure is very high in light emission efficiency, and is employed by almost all of EL display devices currently under development.

Other examples of the structure of the EL layer include a laminate structure consisting of an anode, a hole injection layer, a hole transportation layer, a light emitting layer and an electron transportation layer which are layered in this order, and a laminate structure consisting of an anode, a hole injection layer, a hole transportation layer, a light emitting layer, an electron transportation layer and an electron injection layer which are layered in this order. The light emitting layer may be doped with a fluorescent pigment or the like.

In this specification, all layers that are formed between an anode and a cathode are collectively called an EL layer. Therefore the EL layer includes all of the above hole injection layer, hole transportation layer, light, emitting layer, electron transportation layer and electron injection layer.

A pair of electrodes (a cathode and an anode) applies a given voltage to the EL layer structured as above, whereby carrier recombination takes place in the light emitting layer to cause the layer to emit light. The voltage applied between two electrodes (an anode and a cathode) of an EL element is herein referred to as EL driving voltage. An EL element emitting light is herein expressed as an EL element being driven. A light emitting element composed of an anode, an EL layer and a cathode herein will be referred to as EL element.

FIG. 4 is a block diagram showing a multi-gray scale EL display device. The display device shown here is of the type that obtains gray scale by inputting a digital signal into a source signal line driving circuit and uses a digital gray scale method. Particularly the case of using time division gray scale method for varying the luminance by controlling the period of time during which a pixel emits light will be described.

The EL display device of FIG. 4 has a pixel portion 101 and a source signal line driving circuit 102 and a gate signal line driving circuit 103 which are arranged in the periphery of the pixel portion 101. The pixel portion and the driving circuits are composed of thin film transistors (hereinafter referred to as TFTs) formed on a substrate. An external switch 116 for controlling the EL driving voltage is connected to the pixel portion 101.

The source signal line driving circuit 102 includes, basically a shift register 102*a*, a latch (A) 102*b* and a latch (B) 102*c*. The shift register 102*a* receives input of a clock signal (CLK) and a start pulse (SP). The latch (A) 102*b* receives input of digital data signals (denoted by VD in FIG. 4) whereas the latch (B) 102*c* receives input of latch signals (denoted by S_LAT in FIG. 4).

The digital data signals VD to be inputted to the pixel portion 101 are generated in a time division gray scale data signal generating circuit 114. This circuit converts video signals that are analog signals or digital signals containing image information into the digital data signals VD for time division gray scale. The circuit 114 also generates a timing pulse or the like that is necessary for time division gray scale display.

Typically, the time division gray scale data signal generating circuit 114 includes means for dividing one frame period into a plurality of sub-frame periods in accordance with n bit gray scale (n is an integer of 2 or greater), means for selecting either a writing period or a display period in each of the plural sub-frame periods, and means for setting the length of the display period.

The pixel portion 101 is structured generally as shown in FIG. 5. In FIG. 5, the pixel portion 101 is provided with gate signal lines (G1 to Gy) to which a selecting signal is inputted and source signal lines (also called data signal lines) (S1 to Sx) to which a digital data signal is inputted. The digital data signal refers to a digital video signal.

The pixel portion also has power supply lines (V1 to Vx) parallel to the source signal lines (S1 to Sx). The electric potential of the power supply lines (V1 to Vx) is called a power supply electric potential. Wirings (Vb1 to Vby) are provided in parallel with the gate signal lines (G1 to Gy). The wirings (Vb1 to Vby) are connected to the external switch 116.

A plurality of pixels 104 are arranged in matrix in the pixel portion 101. One of the pixels 104 is enlarged and shown in FIG. 6. In FIG. 6, reference symbol 1701 denotes a TFT functioning as a switching element (hereinafter referred to as switching TFT). 1702 denotes a TFT functioning as an element for controlling a current supplied to an EL element 1703 (current controlling element) (The TFT will be called a driving TFT). Designated by 1704 is a capacitor storage.

The switching TFT 1701 has a gate electrode connected to a gate signal line 1705 that is one of the gate signal lines (G1 to Gy) to which a gate signal is inputted. The switching TFT 1701 has a source region and a drain region one of which is connected to a source signal line 1706 and the other of which is connected to a gate electrode of the driving TFT 1702 and to the capacitor storage 1704. The source signal line 1706 is one of the source signal lines. (S1 to Sx) to which a digital data signal is inputted.

The driving TFT 1702 has a source region and a drain region one of which is connected to a power supply line 1707 and the other of which is connected to the EL element 1703. The power supply line 1707 is one of the power supply lines (V1 to Vx). The capacitor storage 1704 is connected to the power supply line 1707 that is one of the power supply lines (V1 to Vx).

The EL element 1703 is composed of an anode, a cathode, and an EL layer interposed between the anode and the cathode. When the anode is connected to the source region or the drain region of the driving TFT 1702, the anode serves as a pixel electrode whereas the cathode serves as an opposite electrode. On the other hand, when the cathode is connected to the source region or the drain region of the driving TFT 1702, the cathode serves as the pixel electrode whereas the anode serves as the opposite electrode. The electric potential of the opposite electrode is herein called an opposite electric potential. The difference in electric potential between the opposite electrode and the pixel electrode generates the EL driving voltage, which is applied to the EL layer.

The opposite electrode of the EL element 1703 is connected to the external switch 116 through one of the wirings (Vb1 to Vby). (See FIG. 5.) Next, driving the multi-gray scale EL display device in accordance with the time division gray scale method will be described. The description given here takes as an example the case where n bit digital video signals are inputted to obtain display in $2^n$ gray scales.

FIG. 7 shows a timing chart thereof.

First, one frame period is divided into n sub-frame periods ($SF_1$ to $SF_n$).

A period during which one image is displayed using all of the pixels in the pixel portion is defined as one frame period (F). Here, one frame period is set to about 1/60 second. With the period set to this long, human eyes do not recognize flicker in animated images displayed.

As the number of gray scales is increased, the number of sub-frame periods in one frame period also increases and the driving circuits (the source signal line driving circuit and the gate signal line driving circuit), the source signal line driving circuit in particular, has to be driven at a higher frequency.

Each sub-frame period is divided into a wiring period (Ta) and a display period (Ts). The writing period is a period for inputting signals into all of the pixels in one sub-frame period. The display period (also called a lights-on period) is a period for choosing whether or not the EL element emits light so that an image is displayed.

The EL driving voltage shown in FIG. 7 corresponds to the EL driving voltage of the EL element when the EL element is caused to emit light. To elaborate, the EL driving voltage of the EL element in the pixel which is designated to emit light is in the level that does not cause the EL element to emit light, e.g., 0 V, during the writing period. During the display period, on the other hand, the EL driving voltage thereof is in the level that allows the EL element to emit light.

The opposite electric potential is controlled by the external switch 116 shown in FIGS. 4 and 5. During the writing period, the opposite electric potential is kept at the same level as the power supply electric potential. On the other hand, the opposite electric potential is changed in the display period so as to generate an electric potential difference between the opposite electric potential and the power supply electric potential which causes the EL element to emit light.

Detailed descriptions will be given first on the writing period and the display period of the respective sub-frame periods using the reference symbols in FIGS. 5 and 6. Then time division gray scale display will be described.

First, a gate signal is inputted to the gate signal line G1 to turn every switching TFT 1701 connected to the gate signal line G1 ON.

In this specification, a TFT being turned ON means that the gate voltage of the TFT is changed to make the source-drain thereof conductive.

Then the writing period is started and digital data signals are inputted to the source signal lines (S1 to Sx). At this point the opposite electric potential is kept at the same level as the power supply electric potential of the power supply lines (V1 to Vx). The digital data signals contain information of '0' or '1'. The digital data signals of '0' and '1' are signals having Hi voltage and Lo voltage, respectively.

The digital data signals inputted to the source signal lines (S1 to Sx) are inputted to the gate electrode of each driving TFT 1702 through each switching TFT 1701 that has been turned ON. The capacitor storage 1704 also receives input of a digital data signal to hold it in.

Selecting signals are successively inputted to the gate signal lines G2 to Gy to repeat the above operation until all of the pixels receive input of the digital data signals and the inputted digital data signals are held in the respective pixels. A period it takes for the digital data signals to be inputted to all of the pixels in each sub-frame period is the writing period.

After inputting the digital data signals to all of the pixels, every switching TFT 1701 is turned OFF.

A TFT being turned OFF means that the gate voltage of the TFT is changed to make the source-drain thereof unconductive.

Thereafter, the external switch 116 connected to the opposite electrode is used to change the electric potential difference between the opposite electric potential and the power supply electric potential to a degree that causes the EL element to emit light.

When a digital data signal has information of '0', the driving TFT 1702 is turned OFF and the EL element 1703 does not emit light. When a digital data signal has information of '1' on the other hand, the driving TFT 1702 is turned ON. Then the pixel electrode of the EL element 1703 is kept at the power supply electric potential and the EL element 1703 emits light. In this way, information contained in a digital data signal determines whether the EL element emits light or not. Every pixel whose EL element is designated to emit light is simultaneously lit up, and the lit-up pixels together form an image. A period during which the display by the pixels lasts is the display period.

The writing periods ($Ta_1$ to $Ta_n$) in the n sub-frame periods ($SF_1$ to $SF_n$) have the same length. The sub-frame periods $SF_1$ to $SF_n$ have display periods $Ts_1$ to $Ts_n$, respectively.

For instance, the length of the display periods may be set so as to satisfy the relation $Ts_1:Ts_2:Ts_3:\ldots:Ts_{(n-1)}:Ts_n=2^0:2^{-1}:2^{-2}:\ldots:2^{-(n-2)}:2^{-(n-1)}$. Display of desired gray scales within the range of $2^n$ gray scales can be obtained through combinations of the display periods.

Here, given pixels are lit up for the period $Ts_n$.

Then, a writing period is started again so that all the pixels receive digital data signals to start the display period. Subsequently, one of the display periods $Ts_1$ to $Ts_{(n-1)}$ is started. Here, given pixels are lit up for the period $Ts_{(n-1)}$.

The same operation is repeated for the remaining (n−2) sub-frame periods, so that the display periods $Ts_{(n-2)}$, $Ts_{(n-}$ 3), and $Ts_1$ are sequentially set and given pixels are lit up during each of the sub-frame periods.

One frame period is completed when n sub-frame periods have come and gone. The cumulative length of the display periods during which a pixel is lit up determines the gray scale of the pixel.

For example, the luminance is 100% when n=8 and the pixel in question emits light in all display periods. When the pixel emits light only in the display periods $Ts_1$ and $Ts_2$, the luminance is 75%. If the pixel is designated to emit light during the display periods $Ts_3$, $Ts_5$ and $Ts_8$, the luminance may be 16%.

SUMMARY OF THE INVENTION

An object of the present invention is to improve the image quality of an EL display device, in particular, an EL display device using a bottom gate TFT. The object will be detailed below.

When the time division gray scale method described above is employed, the amount of current flowing into an EL element in a pixel is desirably kept constant throughout the display period of each sub-frame period. In actuality, however, the amount of current varies depending on the temperature.

FIG. 18 is a graph showing the temperature characteristic of the EL element. The axis of abscissa shows the applied voltage that is applied between two electrodes of the EL element. The axis of ordinate shows the amount of current flowing into the EL element.

One can tell from this graph how much current flows into the EL element when a voltage is applied between the electrodes of the EL element at a certain temperature. Temperature $T_1$ is higher than temperature $T_2$, which is higher than temperature $T_3$.

The graph shows that the same level of voltage applied between the electrodes of the EL element in the pixel portion does not always cause the same amount of current to flow through the EL element; the amount of current flowing into the EL element may increase as the temperature of the EL layer rises, depending on the temperature characteristic of the EL element.

Thus the amount of current flowing through the EL element in the pixel portion varies depending on the temperature at which the EL display device is used (hereinafter referred to as surrounding temperature), whereby the luminance of the EL element in the pixel portion is changed. Therefore the accuracy in gray scale display cannot be maintained, contributing to impaired reliability of EL display devices.

Furthermore, current consumption is increased when the amount of current flowing through the EL element is increased.

Another object of the present invention is to control those change in luminance and increase in power consumption of the EL element due to a change in surrounding temperature.

Moreover, bottom gate TFTs have the following two problems.

Problem one is as follows.

In bottom gate TFTs, side walls of a gate electrode has to be gentle because, according to the manufacturing process, an insulating film and a semiconductor thin film are to be formed thereon. Therefore, the width of the gate electrode (gate length) in bottom gate TFTs cannot be as small as the width of a gate electrode (gate length) in top gate TFTs, where side walls of the gate electrode are not required to be so gentle.

Problem Two is as follows.

In bottom gate TFTs, a gate electrode is formed under a semiconductor thin film that is to be used as a source region and a drain region and hence the semiconductor thin film is convexed. If a polycrystalline film such as a polysilicon film is used as the convex semiconductor thin film, the crystallinity of the film is inferior to that of a polycrystalline film formed on a flat surface, and characteristics such as an electric field effect mobility (mobility) are also poor.

Because of these problems, the frequency characteristic of a driver circuit composed of a bottom gate TFT is inferior to the frequency characteristic of a driver circuit composed of a top gate TFT.

In a display device that has a large display screen as well as a large number of pixels satisfying the VGA standard or higher, there are needed many source signal lines and high-speed operation. High-speed operation is also necessary in the case that the time division gray scale method described above is employed and a plurality of sub-frame periods are provided. Accordingly, the operation speed is insufficient especially in a source signal line driving circuit that uses a bottom gate TFT.

To sum up the objects of the present invention, the invention aims at providing a display device which is capable of controlling the change in luminance and increase in current consumption of an EL element due to a change in surrounding temperature, and which can obtain a larger screen, higher definition and more gray scales despite the inferior frequency characteristic of a source signal line driving circuit that is composed of a bottom gate TFT.

In order to attain the above objects, an EL element for monitoring the temperature (hereinafter referred to as monitoring EL element) is provided in an EL display device. One electrode of the temperature monitoring EL element is connected to a constant current generator. The temperature characteristic of the monitoring EL element is utilized to keep the amount of current flowing into an EL element of a pixel constant. Furthermore, a video signal is subjected to time base expansion so as to give margin to sampling of the video signal in a source signal line driving circuit.

Hereinafter, structures of the present invention are described.

According to the present invention, there is provided a display device comprising a plurality of EL elements of a plurality of pixels and a monitoring EL element, characterized in that the temperature characteristic of the monitoring EL element is used to reduce a change in amount of current flowing through the plural EL elements due to temperature change.

According to the present invention, there is provided a display device comprising:

a pixel portion having a plurality of pixels;

a power supply line;

a buffer amplifier;

a monitoring EL element; and a constant current generator, characterized in that:

the plural pixels each have a thin film transistor and an EL element;

the monitoring EL element and the EL element each have a first electrode, a second electrode, and an EL layer interposed between the first electrode and the second electrode;

the first electrode of the monitoring EL element is connected to the constant current generator;

the first electrode of the monitoring EL element is connected to a non-inversion input terminal of the buffer amplifier;

an output terminal of the buffer amplifier is connected to the power supply line; and the electric potential of the power supply line is given to the first electrode of the EL element through the thin film transistor.

According to the present invention, there is provided a display device comprising:

a pixel portion having a plurality of pixels;

a power supply line;

a buffer amplifier;

a monitoring EL element;

a constant current generator; and an adder circuit, characterized in that:

the plural pixels each have a thin film transistor and an EL element;

the monitoring EL element and the EL element each have a first electrode, a second electrode, and an EL layer interposed between the first electrode and the second electrode;

the first electrode of the monitoring EL element is connected to the constant current generator;

the first electrode of the monitoring EL element is connected to a non-inversion input terminal of the buffer amplifier;

an output terminal of the buffer amplifier is connected to an input terminal of the adder circuit;

an output terminal of the adder circuit is connected to the power supply line;

the difference in electric potential between the input terminal of the adder circuit and the output terminal thereof is kept constant; and the electric potential of the power supply line is given to the first electrode of the EL element through the thin film transistor.

According to the present invention, there is provided a display device comprising:

a plurality of source signal lines;

a plurality of gate signal lines;

a plurality of power supply lines;

a plurality of pixels;

a source signal line driving circuit for inputting a signal into the plural source signal lines;

a gate signal line driving circuit for inputting a signal to the plural gate signal lines;

a monitoring EL element; and an insulating substrate on which the above components are formed, characterized in that:

the plural pixels each have an EL element, a switching TFT, a driving TFT and a capacitor storage;

the monitoring EL element and the EL element each have a first electrode, a second electrode, and an EL layer interposed between the first electrode and the second electrode;

the switching TFT has a gate electrode connected to one of the plural gate signal lines, and has a source region and a drain region one of which is connected to one of the plural source signal lines and the other of which is connected to a gate electrode of the driving TFT;

the driving TFT has a source region and a drain region one of which is connected to one of the plural power supply lines and the other of which is connected to the first electrode or the second electrode of the EL element;

one electrode of the capacitor storage is connected to one of the plural power supply lines and the other electrode is connected to the gate electrode of the driving TFT; and the monitoring EL element is used to reduce a change in amount of current flowing from one of the plural power supply lines into the EL element due to a temperature change.

According to the present invention, there is provided a display device comprising:

a plurality of source signal lines;

a plurality of gate signal lines;

a plurality of power supply lines;

a plurality of pixels;

a source signal line driving circuit for inputting a signal into the plural source signal lines;

a gate signal line driving circuit for inputting a signal to the plural gate signal lines;

a monitoring EL element;

a buffer amplifier;

a constant current generator: and an insulating substrate on which the above components are formed, characterized in that:

the plural pixels each have an EL element, a switching TFT, a driving TFT and a capacitor storage;

the monitoring EL element and the EL element each have a first electrode, a second electrode, and an EL layer interposed between the first electrode and the second electrode;

the switching TFT has a gate electrode connected to one of the plural gate signal lines;

the switching TFT has a source region and a drain region one of which is connected to one of the plural source signal lines and the other of which is connected to a gate electrode of the driving TFT;

the driving TFT has a source region and a drain region one of which is connected to one of the plural power supply lines and the other of which is connected to the first electrode of the EL element;

one electrode of the capacitor storage is connected to one of the plural power supply lines and the other electrode is connected to the gate electrode of the driving TFT;

the first electrode of the monitoring EL element is connected to the constant current generator;

the first electrode of the monitoring EL element is connected to a non-inversion input terminal of the buffer amplifier;

an output terminal of the buffer amplifier is connected to the power supply lines: and the electric potential of each of the power supply lines is given to the first electrode of the EL element through the driving TFT.

According to the present invention, there is provided a display device comprising:

a plurality of source signal lines;

a plurality of gate signal lines;

a plurality of power supply lines;

a plurality of pixels;

a source signal line driving circuit for inputting a signal into the plural source signal lines;

a gate signal line driving circuit for inputting a signal to the plural gate signal lines;

a monitoring EL element;

a buffer amplifier;

a constant current generator:

an adder circuit; and an insulating substrate on which the above components are formed, characterized in that:

the plural pixels each have an EL element, a switching TFT, a driving TFT and a capacitor storage;

the monitoring EL element and the EL element each have a first electrode, a second electrode, and an EL layer interposed between the first electrode and the second electrode;

the switching TFT has a gate electrode connected to one of the plural gate signal lines;

the switching TFT has a source region and a drain region one of which is connected to one of the plural source signal lines and the other of which is connected to a gate electrode of the driving TFT;

the driving TFT has a source region and a drain region one of which is connected to one of the plural power supply lines and the other of which is connected to the first electrode of the EL element;

one electrode of the capacitor storage is connected to one of the plural power supply lines and the other electrode is connected to the gate electrode of the driving TFT;

the first electrode of the monitoring EL element is connected to the constant current generator;

the first electrode of the monitoring EL element is connected to a non-inversion input terminal of the buffer amplifier;

an output terminal of the buffer amplifier is connected to an input terminal of the adder circuit;

an output terminal of the adder circuit is connected to the power supply lines;

the difference in electric potential between the input terminal of the adder circuit and the output terminal thereof is kept constant; and the electric potential of each of the power supply lines is given to the first electrode of the EL element through the driving TFT.

There may be provided a display device, characterized in that the first electrode is an anode and the second electrode is a cathode in both of the monitoring EL element and the EL element.

There may be provided a display device, characterized in that the first electrode is a cathode and the second electrode is an anode in both of the monitoring EL element and the EL element.

There may be provided a display device, characterized in that at least one of the buffer amplifier and the constant current generator is composed of a thin film transistor formed on the same substrate on which the thin film transistor of each pixel is formed.

There may be provided a display device, characterized in that-at least one of the buffer amplifier, the constant current generator and the adder circuit is composed of a thin film transistor formed on the same substrate on which the thin film transistor of each pixel is formed.

There may be provided a display device, characterized in that at least one of the buffer amplifier and the constant current generator is composed of a TFT formed on the same substrate on which the switching TFT and the driving TFT are formed.

There may be provided a display device, characterized in that at least one of the buffer amplifier, the constant current generator and the adder circuit is composed of a TFT formed on the same substrate on which the switching TFT and the driving TFT are formed.

According to the present invention, there is provided a display device comprising:

a plurality of EL elements of a plurality of pixels;

a plurality of pixel TFTs constituting the plural pixels;

a source signal line driving circuit and a gate signal line driving circuit which drive the pixel TFTs; and an insulating substrate on which the above components are formed, characterized in that the source signal line driving circuit has means for successively sampling digital video signals, the sampling being performed simultaneously on a plurality of signals.

According to the present invention, there is provided a display device comprising:

a plurality of EL elements of a plurality of pixels;

a plurality of pixel TFTs constituting the plural pixels;

a source signal line driving circuit and a gate signal line driving circuit which drive the pixel TFTs; and an insulating substrate on which the above components are formed, characterized in that the source signal line driving circuit has means for successively sampling digital signals that have been subjected to k-fold time expansion (k is a natural number), the sampling being performed simultaneously on k video signals.

According to the present invention, there is provided a display device comprising:

a plurality of EL elements of a plurality of pixels;

a plurality of pixel TFTs constituting the plural pixels:

a source signal line driving circuit and a gate signal line driving circuit which drive the pixel TFTs; and an insulating substrate on which the above components are formed, characterized in that the source signal line driving circuit has means for successively sampling analog video signals, the sampling being performed simultaneously on a plurality of signals.

According to the present invention, there is provided a display device comprising:

a plurality of EL elements of a plurality of pixels;

a plurality of pixel TFTs constituting the plural pixels;

a source signal line driving circuit and a gate signal line driving circuit which drive the pixel TFTs; and an insulating substrate on which the above components are formed, characterized in that the source signal line driving circuit has means for successively sampling analog signals that have been subjected to k-fold time expansion (k is a natural number), the sampling being performed simultaneously on k video signals.

There may be provided a display device, characterized in that the TFT constituting the source signal line driving circuit is a bottom gate TFT.

There may be provided a display device, characterized in that the EL element uses an EL layer emitting monochrome light and color conversion layers in combination to provide color display.

There may be provided a display device, characterized in that the EL element uses an EL layer emitting white light and color filters in combination to provide color display.

There may be provided a display device, characterized in that the EL layer of the EL element is formed from a low molecular weight organic material or a polymer organic material.

There may be provided a display device, characterized in that the low molecular weight organic material contains $Alq_3$ (tris-8-quinolilite-aluminum) or TPD (triphenylamine derivative).

There may be provided a display device, characterized in that the polymer organic material contains PPV (polyphenylene vinylene), PVK (polyvinyl carbazole) or polycarbonate.

There may be provided a display device, characterized in that the EL layer of the EL element is formed from an inorganic material.

There may be provided a computer, a television set, a telephone, a monitor device and a navigation system for automobiles, each of which employs the display device.

BRIEF DESCRIPTION OF THE DRAWINGS

In the accompanying drawings:

FIGS. 25A to 25F are diagrams showing electronic equipment to which an EL display device of the present invention is applied.

DETAILED DESCRIPTION OF THE PREFERRED EMBODIMENTS

Embodiment Mode 1

Figure 1:
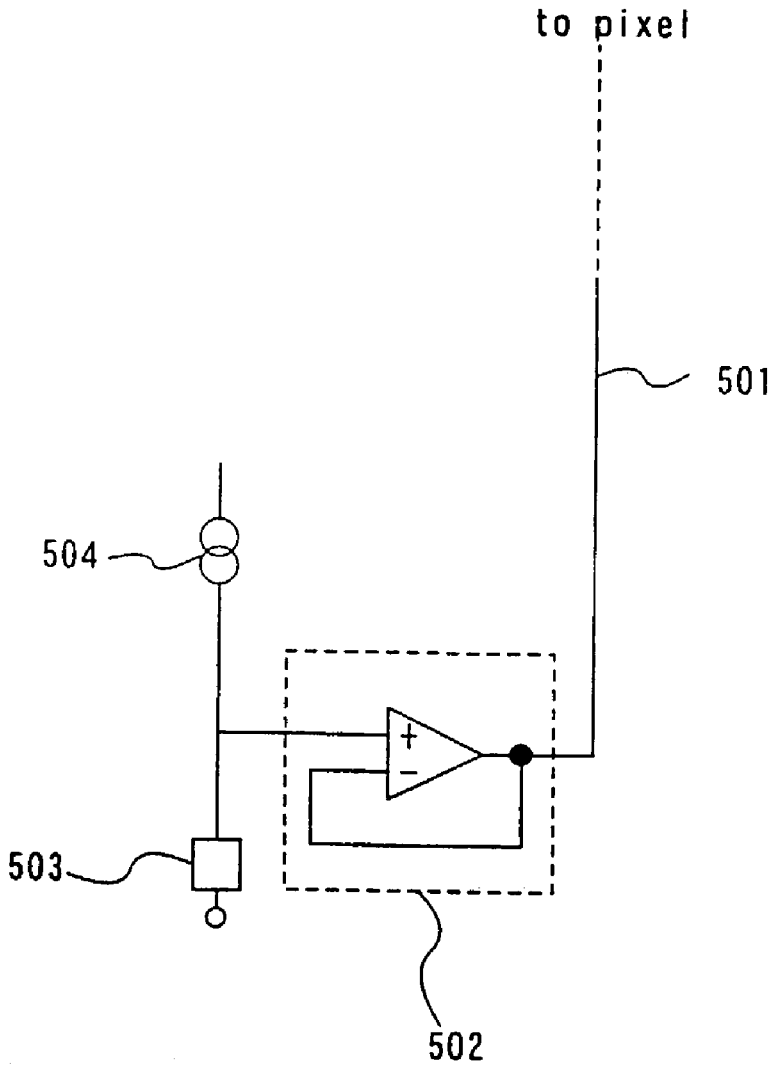
FIG. 1 is a diagram showing the structure of a temperature compensation circuit of an EL display device according to the present invention.

The structure of the present invention will be described with reference to FIG. 1.

Reference symbol 501 denotes a power supply line. The power supply line herein corresponds to a wiring for providing one electrode of an EL element (not shown) in a pixel portion with a given electric potential in response to a digital data signal inputted to a source signal line. In this specification, the electric potential of the power supply line is called a power supply electric potential.

Reference symbol 502 denotes a buffer amplifier, 503., a monitoring EL element, and 504, a constant current generator. One electrode of the monitoring EL element 503 is connected to the constant current generator 504, so that a constant amount of current flows through the monitoring EL element 503. When the temperature of an EL layer of the EL element changes, the amount of current flowing into the monitoring EL element 503 does not change but instead the electric potential of the electrode of the monitoring EL element 503 which is connected to the constant current generator 504 changes.

The monitoring EL element 503 and an EL element in each pixel are manufactured such that the relation of the amount of current flowing into the element to the level of voltage applied between two electrodes of the element is the same for both the monitoring EL element 503 and the pixel EL element at the same temperature.

Here, an electrode of the pixel EL element (pixel electrode) which is connected to the power supply line 501 is an anode if an electrode of the monitoring EL element 503 which is connected to the buffer amplifier 502 is an anode. On the other hand, if the electrode of the monitoring EL element 503 which is connected to the buffer amplifier 502 is a cathode, the electrode of the pixel EL element (pixel electrode) which is connected to the power supply line 501 is a cathode.

An electrode of the monitoring EL element 503 which is not connected to the buffer amplifier 502 and an opposite electrode of the pixel portion EL element are given here almost the same electric potential.

The buffer amplifier 502 has two input terminals and one output terminal. One of the input terminals is a non-inversion input terminal (+) and the other is an inversion input terminal (−). The electric potential of one electrode of the monitoring EL element 503 is given to the non-inversion input terminal of the buffer amplifier 502. The output terminal of the buffer amplifier is connected to the power supply line 501. The non-inversion input terminal of the buffer amplifier is connected to the output terminal of the buffer amplifier.

The buffer amplifier is a circuit for preventing load such as wiring capacitance of the power supply line 501 from changing the electric potential of the electrode of the monitoring EL element 503 which is connected to the constant current generator 504. Accordingly, the electric potential given to the non-inversion input terminal of the buffer amplifier 502 is outputted from the output terminal without being changed by load such as wiring capacitance of the power supply line 501 to be given as the power supply electric potential to the power supply line 501.

Therefore the power supply electric potential changes such that the amount of current flowing into the EL element is kept constant even when the surrounding temperature changes to change the temperature of the EL layers of the monitoring EL element 503 and of the pixel portion EL element. This prevents the change in luminance and increase in current consumption due to a change in surrounding temperature.

According to this embodiment mode, the buffer amplifier 502 may be formed on the same substrate as the pixel portion or on an IC chip. The same applies to the monitoring EL element 503 and the constant current generator 504.

The monitoring EL element 503 may be included in the pixel portion or may be provided separately from the pixel portion.

Embodiment Mode 2

In the case where high-speed operation is required, as a measure to make up the insufficient frequency characteristic of a bottom gate TFT, a source signal line driving circuit composed of the bottom gate TFT is divided into several blocks. Each of the blocks simultaneously processes signals associated with some source signal lines, thereby increasing the processing speed of the source signal line driving circuit.

Figure 17:
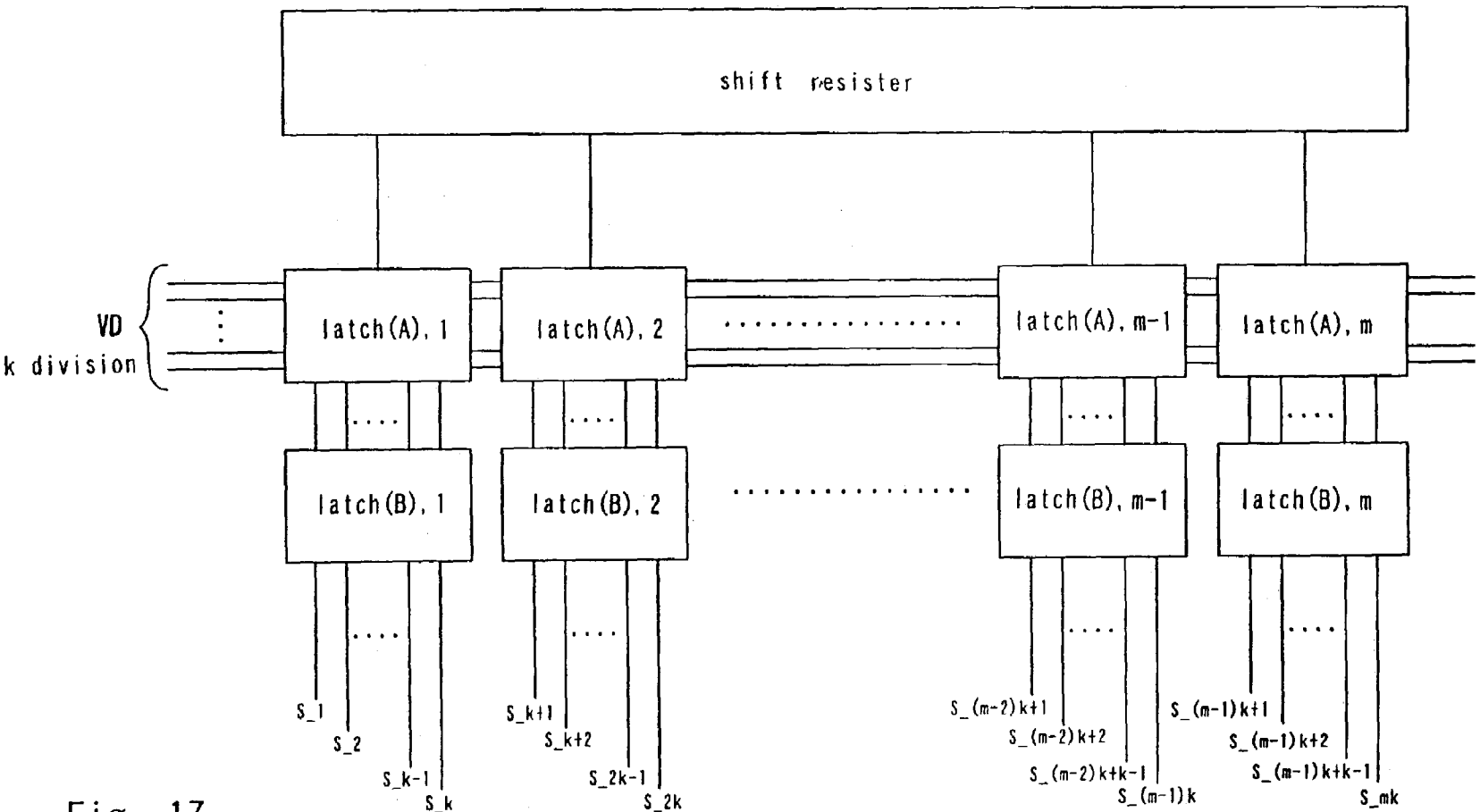
FIG. 17 is a block diagram showing a source signal line driving circuit of an EL display device according to the present invention.
Figure 18:
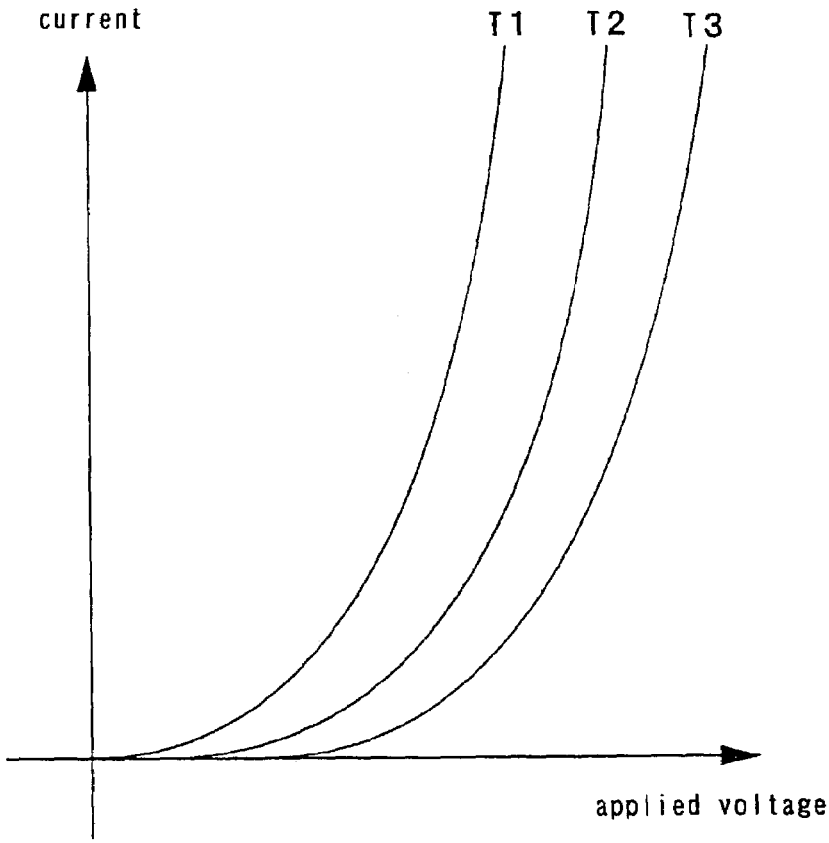
FIG. 18 is a graph showing the temperature characteristic of an EL element.

A description given first is of a case in which the source signal line driving circuit is driven with the circuit divided into several blocks while employing the time division gray scale method described in the example of prior art. FIG. 17 is a schematic diagram of the source signal line driving circuit.

The source signal line driving circuit is divided into blocks associated with outputs to k source signal lines. Specifically, a latch (A) and a latch (B) each consist of m blocks (the latch (A) has a latch (A), 1 to a latch (A), m, and the latch (B) has a latch (B), 1 to a latch (B), m). Each block consists of k latch circuits.

A digital data signal VD inputted from the external is divided into k parts.

The digital data signal VD divided into k parts is obtained by using an external time division signal generating circuit to convert a digital video signal into a signal for the time division gray scale display described above, subjecting to time base expansion a signal of a writing period in each sub-frame period of the converted signal, and converting the expanded signal into a parallel signal for the respective signals associated with the k source signal lines.

A circuit for conducting the time base expansion is provided separately from and outside of the display device.

In response to a signal from a shift register, the block latch (A), 1 simultaneously samples the k parts of the digital data signal VD which are associated with the outputs to the k source signal lines. Similarly, the rest of the blocks of the latch (A) (the latch (A), 2 to the latch (A), m) are selected in order until the k parts of the digital data signal VD which are associated with the outputs to all source signal lines S_1 to S_mk are held in the latch (A). Thereafter, a latch pulse is inputted to the latch (B). Upon input of the latch pulse, the signals held in the blocks of the latch (A) are inputted to the latch (B) all at once, and outputted to the source signal lines S_1 to S_mk.

As described above, it takes about 1/k time for the shift register of the source signal line driving circuit to process if the source signal line driving circuit is divided, as compared with the case where the source signal line driving circuit is not divided.

It is effective also in other driving methods than the time division gray scale method to convert a digital video signal to be inputted to the source signal line driving circuit into a parallel signal for the respective signals associated with the k source signal lines and to simultaneously process the signals associated with the k source signal lines so that the source signal line driving circuit can operate with a margin.

It is thus possible to provide a display device which has a source signal line driving circuit composed of a bottom gate TFT and is yet capable of obtaining a larger screen, higher definition and more gray scales.

Embodiment Modes 1 and 2 can be carried out in combination without restriction.

Embodiments of the present invention will be described below.

Embodiment 1

This embodiment gives a description about a case of using a temperature compensation circuit having a structure different from the structure shown in FIG. 1 in accordance with Embodiment Mode 1.

Figure 2:
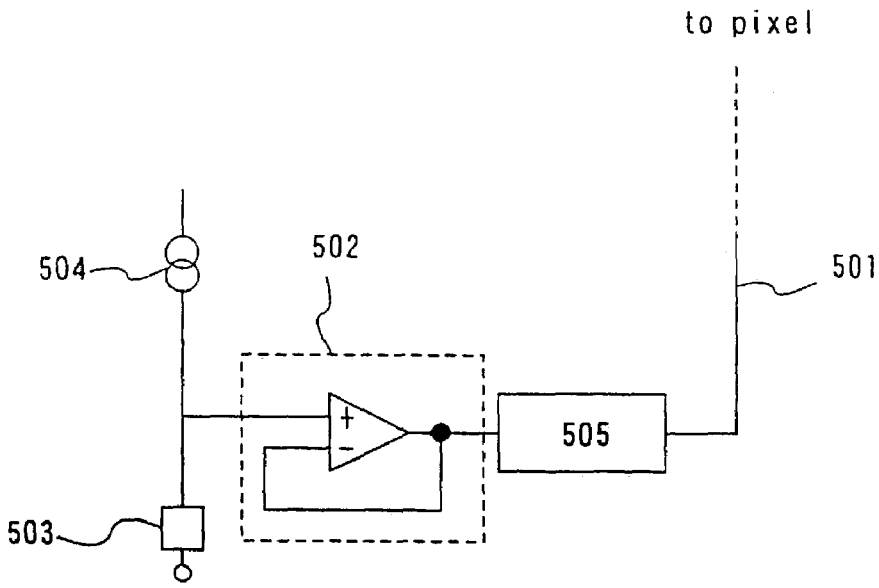
FIG. 2 is a diagram showing the structure of another temperature compensation circuit of the EL display device according to the present invention.

FIG. 2 shows the structure of a temperature compensation circuit according to this embodiment.

Reference symbol 501 denotes a power supply line, 502, a buffer amplifier, 503, a monitoring EL element, 504, a constant current generator, and 505, an adder circuit. One electrode of the monitoring EL element 503 is connected to the constant current generator 504, so that a constant amount of current flows through the monitoring EL element 503. When the temperature of an EL layer of the EL element changes, the amount of current flowing into the monitoring EL element 503 does not change but instead the electric potential of the electrode of the monitoring EL element 503 which is connected to the constant current generator 504 changes.

The monitoring EL element 503 and an EL element (not shown) in each pixel are manufactured such that the relation of the amount of current flowing into the element to the level of voltage applied between two electrodes of the element is the same for both the monitoring EL element 503 and the pixel EL element at the same temperature.

Here, an electrode of the pixel EL element (pixel electrode) which is connected to the power supply line 501 is an anode if an electrode of the monitoring EL element 503 which is connected to the buffer amplifier 502 is an anode. On the other hand, if the electrode of the monitoring EL element 503 which is connected to the buffer amplifier 502 is a cathode, the electrode of the pixel EL element (pixel electrode) which is connected to the power supply line 501 is a cathode.

An electrode of the monitoring EL element 503 which is not connected to the buffer amplifier 502 and an opposite electrode of the pixel portion EL element are given here almost the same electric potential.

The buffer amplifier 502 has two input terminals and one output terminal. One of the input terminals is a non-inversion input terminal (+) and the other is an inversion input terminal (−). The electric potential of one electrode of the monitoring EL element 503 is given to the non-inversion input terminal of the buffer amplifier 502.

The buffer amplifier is a circuit for preventing load such as wiring capacitance of the power supply line 501 from changing the electric potential of the electrode of the monitoring EL element 503 which is connected to the constant current generator 504. Accordingly, the electric potential given to the non-inversion input terminal of the buffer amplifier 502 is outputted from the output terminal without being changed by load such as wiring capacitance of the power supply line 501 and the adder circuit 505 to be given to the adder circuit 505.

A certain level of electric potential is added to or subtracted from the electric potential of the output terminal of the buffer amplifier 502 which has been given to the adder circuit 505. Alternatively, the electric potential given to the adder circuit is multiplied several folds. Thereafter, the electric potential of the adder circuit is given to the power supply line 501 as the power supply electric potential.

Figure 3:
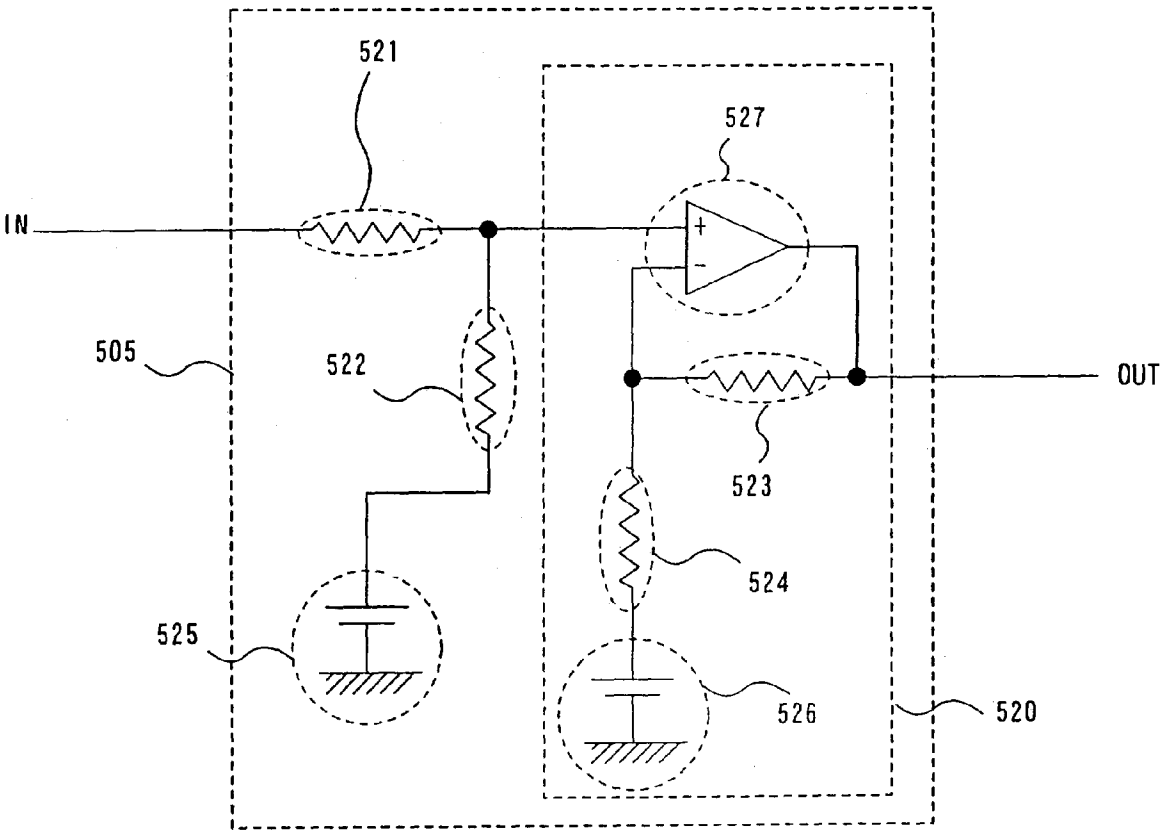
FIG. 3 is a diagram showing the structure of an adder circuit of an EL display device according to the present invention.
Figure 4:
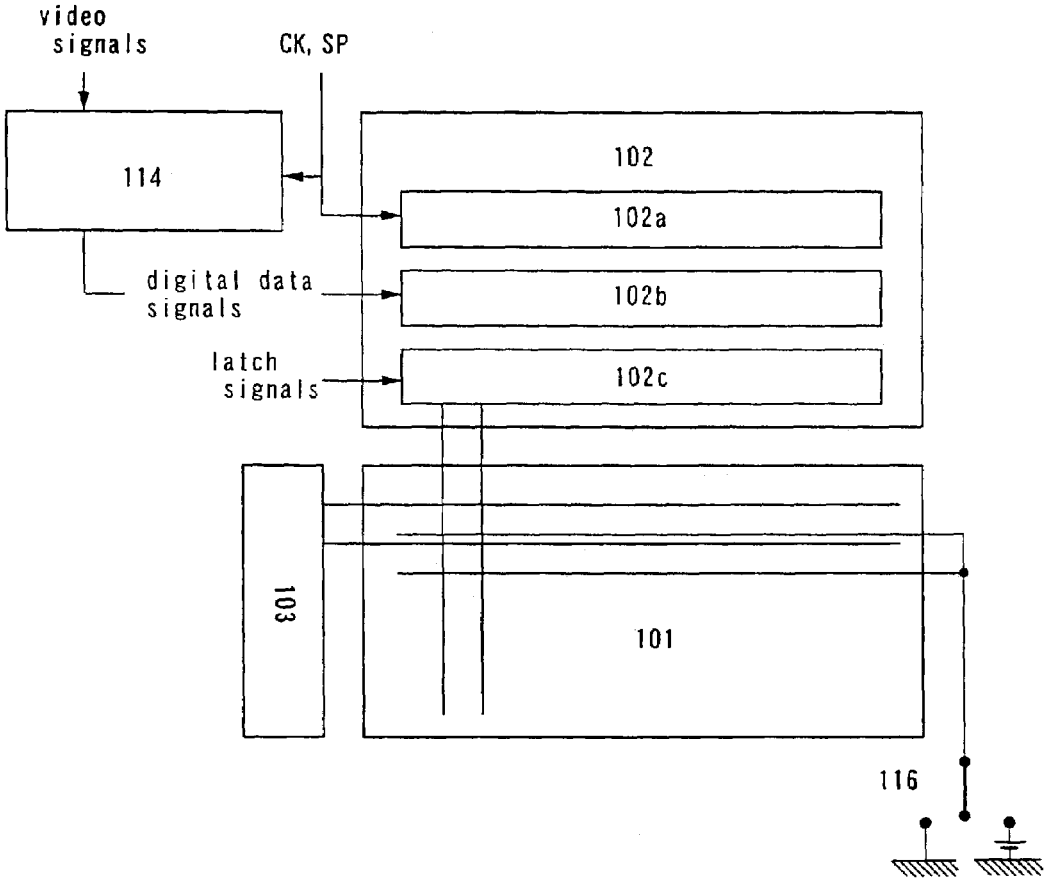
FIG. 4 is a block diagram showing the structure of an EL display device in prior art.
Figure 5:
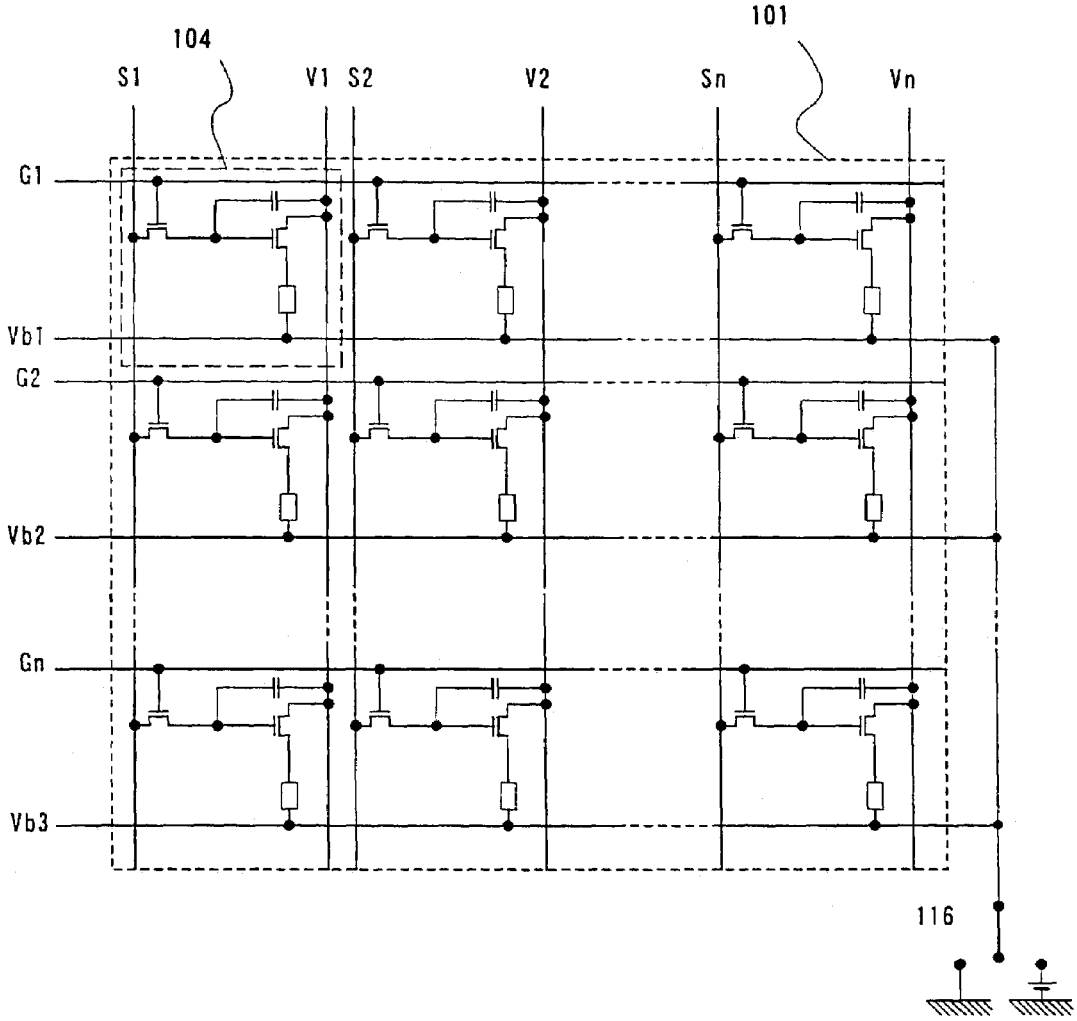
FIG. 5 is a diagram showing the structure of a pixel portion of an EL display device in prior art.
Figure 6:
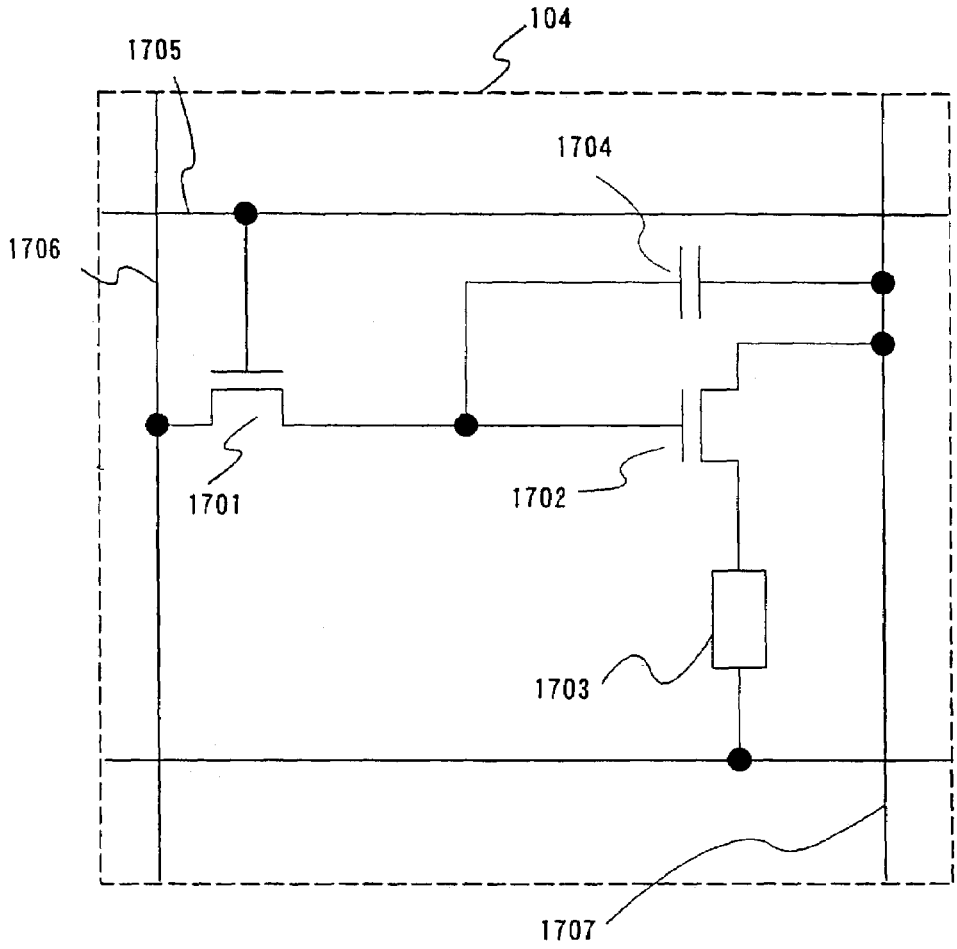
FIG. 6 is a diagram showing the structure of a pixel of an EL display device in prior art.
Figure 7:
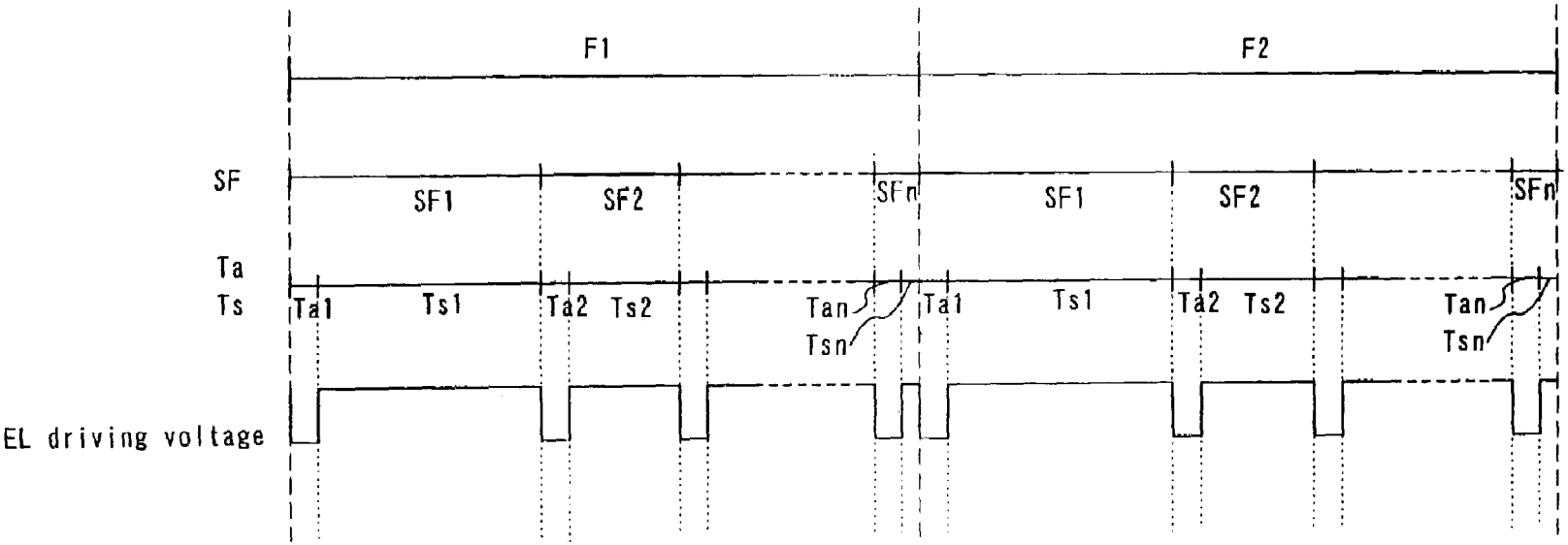
FIG. 7 is a timing chart according to a method of driving an EL display device in prior art.

FIG. 3 shows a detailed circuit diagram of the adder circuit according to this embodiment. The adder circuit 505 has a first resister 521, a second resister 522, an adder circuit power supply 525 and a non-inversion amplifier circuit 520. The non-inversion amplifier circuit 520 is composed of a third resister 523, a fourth resister 524, a non-inversion amplifier circuit power supply 526 and an amplifier 527.

One terminal of the first resister 521 is an input terminal (IN) of the adder circuit. The other terminal of the first resister 521 is connected to one terminal of the second resister 522. The other terminal of the second resister 522 is connected to the adder circuit power supply 525. The output from between the first resister 521 and the second resister 522 is inputted to a non-inversion input terminal (+) of the amplifier 527 in the non-inversion amplifier circuit 520.

One terminal of the third resister 523 is connected to an output terminal of the amplifier 527 whereas the other terminal of the third resister 523 is connected to an inversion input terminal of the amplifier 527. The output from between the third resister 523 and the inversion input terminal of the amplifier 527 is inputted to one terminal of the fourth resister 524. The other terminal of the fourth resister 524 is connected to the non-inversion amplifier circuit power supply 526. The output from between the third resister 523 and the output terminal of the amplifier 527 is outputted from an output terminal (OUT) of the adder circuit 505.

With the above structure, the power supply electric potential changes such that the amount of current flowing into the pixel portion EL element is kept constant even when the surrounding temperature changes to change the temperature of the EL layers of the monitoring EL element 503 and of the pixel portion EL element. Therefore the luminance of the pixel portion EL element can be kept constant irrespective of a change in surrounding temperature of the EL display device.

The presence of the adder circuit 505 eliminates the need to set the electric potential of the power supply line 501 (power supply electric potential) to the same level as the electric potential of the electrode of the monitoring EL element 503 which is connected to the constant current generator 504.

The amount of current flowing through the buffer amplifier 502, the monitoring element 503 and the constant current generator 504 can thus be limited. As a result, power consumption of the device can be suppressed.

The structure of the adder circuit 505 is not limited to the one shown in FIG. 3.

According to this embodiment, the buffer amplifier 502 may be formed on the same substrate as the pixel portion or on an IC chip. The same applies to the monitoring EL element 503, the constant current generator 504 and the adder circuit 505.

The monitoring EL element 503 may be included in the pixel portion or may be provided separately from the pixel portion.

Embodiment 2

A description given in this embodiment is on an example of the structure of a buffer amplifier in a temperature compensation circuit of a display device according to the present invention.

Figure 8:
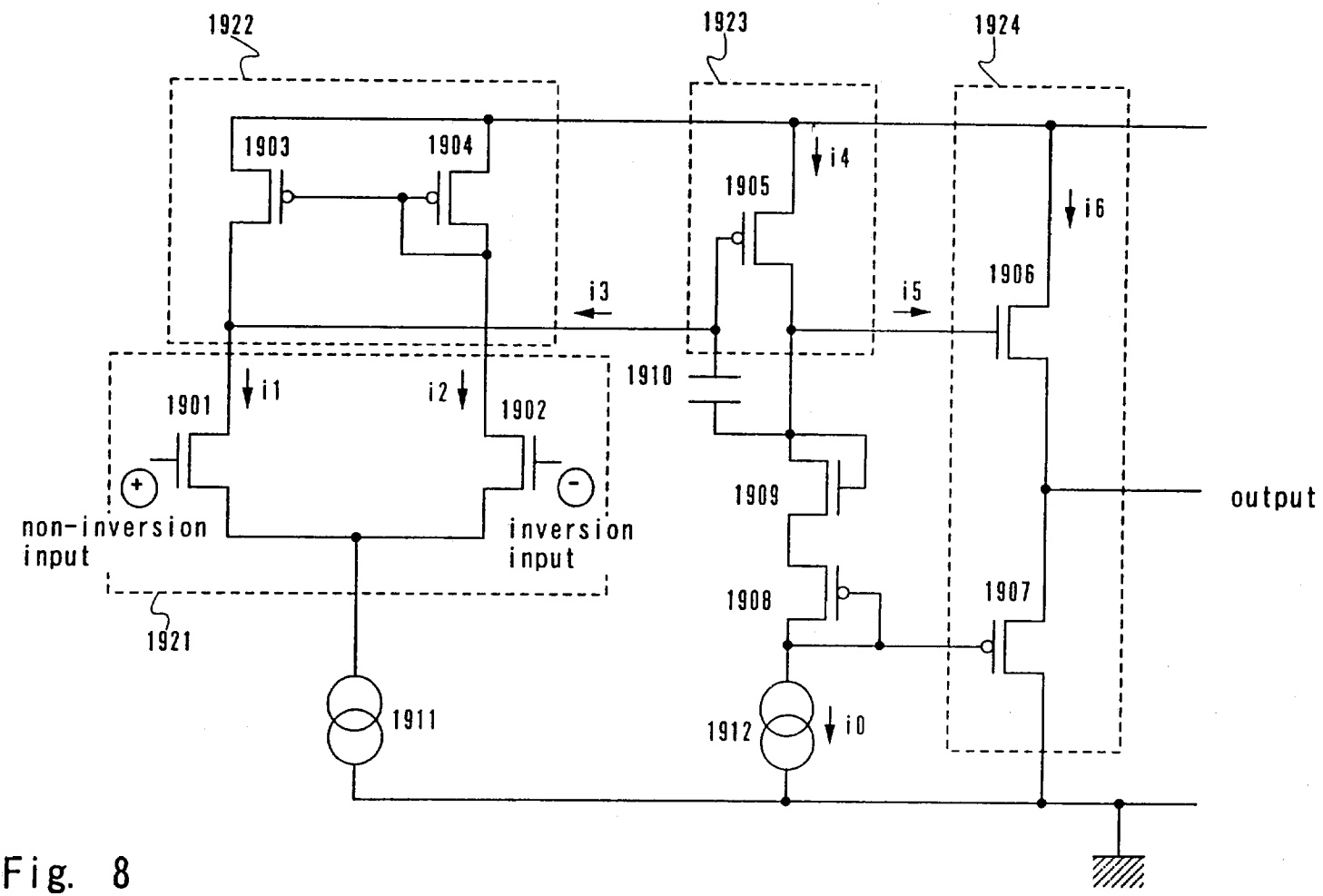
FIG. 8 is a circuit diagram of a buffer amplifier of an EL display device according to the present invention.

FIG. 8 shows a case of manufacturing the buffer amplifier from a TFT that has the same structure as a TFT in a pixel.

The buffer amplifier is composed of TFTs 1901 to 1909, a capacitor 1910, constant current generators 1911 and 1912, and power supply lines 1930 and 1931.

The description given here takes as an example the case in which the TFTs 1901, 1902, 1906 and 1909 are n-channel TFTs whereas the TFTs 1903 to 1905 and the TFTs 1907 and 1908 are p-channel TFTs.

The electric potential of the power supply line 1930 at this point is set higher than the electric potential of the power supply line 1931. The electric potential of the power supply line 1931 is 0 V in FIG. 8, but it is not limited thereto.

The polarity of the TFTs according to this embodiment is not limited to the above. That is, any of the TFTs 1901 to 1909 can choose an n-channel TFT or a p-channel TFT. However, the TFTs 1901 and 1902 constituting a differential amplifier 1921 have to have the same polarity and almost the same characteristics. Also, the TFTs 1903 and 1904 constituting a current mirror circuit 1922 have to have the same polarity and almost the same characteristics.

The operation of this buffer amplifier will be detailed below.

A description will be made of the differential amplifier 1921 that is composed of the TFTs 1901 and 1902.

Source regions of the TFTs 1901 and 1902 connected to each other are connected to the constant current generator 1911.

There is a difference between an electric potential inputted to a gate electrode of the TFT 1901 which corresponds to a non-inversion input terminal of an operation amplifier and an electric potential inputted to a gate electrode of the TFT 1902 which corresponds to an inversion input terminal of the buffer amplifier. The electric potential difference makes the amount of current flowing between a drain and a source of the TFT 1901 different from that of the TFT 1902. The currents in the TFTs 1901 and 1902 are denoted by i1 and i2, respectively.

The current mirror circuit 1922 is composed of the TFTs 1903 and 1904. Source regions of the TFTs 1903 and 1904 are both connected to the power supply line 1930. A drain region of the TFT 1904 and a gate electrode thereof are connected to each other. A gate electrode of the TFT 1903 is connected to the gate electrode of the TFT 1904, and hence the gate electrodes of the two TFTs have the same electric potential. Accordingly, the amount of current flowing between a source and a drain of the TFT 1903 is the same as the amount of current flowing between a source and a drain of the TFT 1904. This means that a current i3 has to be inputted to the current mirror circuit 1922. The current i3 corresponds to the difference between the currents i1 and i2 respectively flowing through the TFTs 1901 and 1902 of the differential amplifier 1921.

The current i3 is supplied from the capacitor 1910. The supply of the current i3 increases an electric potential difference V1 between electrodes of the capacitor 1910. The electric potential difference V1 is then inputted to a source ground amplifier circuit 1923.

The source ground amplifier circuit 1923 is composed of the TFT 1905. The electric potential difference V1 inputted serves as the electric potential between a gate and a source of the TFT 1905. A current i4 is supplied from the power supply line 1930 in accordance with the electric potential difference V1. The constant current generator 1912 only generates a constant current i0. A current i5 corresponding to the difference between the current i4 and the current i0 is therefore inputted to a source follower buffer circuit 1924. The current i5 is increased in accordance with the amplified electric potential difference V1.

The source follower buffer circuit 1924 is composed of the TFTs 1906 and 1907. The current i5 inputted from the source ground amplifier circuit 1923 is inputted to a gate electrode of the TFT 1906. With the input current i5, the gate electric potential of the TFT 1906 is raised to increase a current i6 flowing between a source and a drain of the TFT 1906. As a result, a larger amount of current than in the buffer amplifier is outputted.

When an output terminal of the buffer amplifier and the inversion input terminal thereof are connected to each other here, the buffer amplifier operates such that the electric potential of the output terminal obtains the same level as the electric potential of the non-inversion input terminal. The buffer amplifier thus outputs from its output terminal the same level of voltage as the signal voltage inputted to the non-inversion input terminal.

The structure of the buffer amplifier in the display device of the present invention is not limited to the one shown in FIG. 8, but every known buffer amplifier can be used.

This embodiment can be carried out in combination with Embodiment 1 without restriction.

Embodiment 3

This embodiment describes a method of simultaneously manufacturing TFTs for a pixel portion of a display device according to the present invention and TFTs for driver circuit portions that are provided in the periphery of the pixel portion. To simplify the description, a CMOS circuit that is a basic unit of a driver circuit is illustrated as the driver circuit portions.

Figures 19A, 19B, 19C, 19D, 19E:
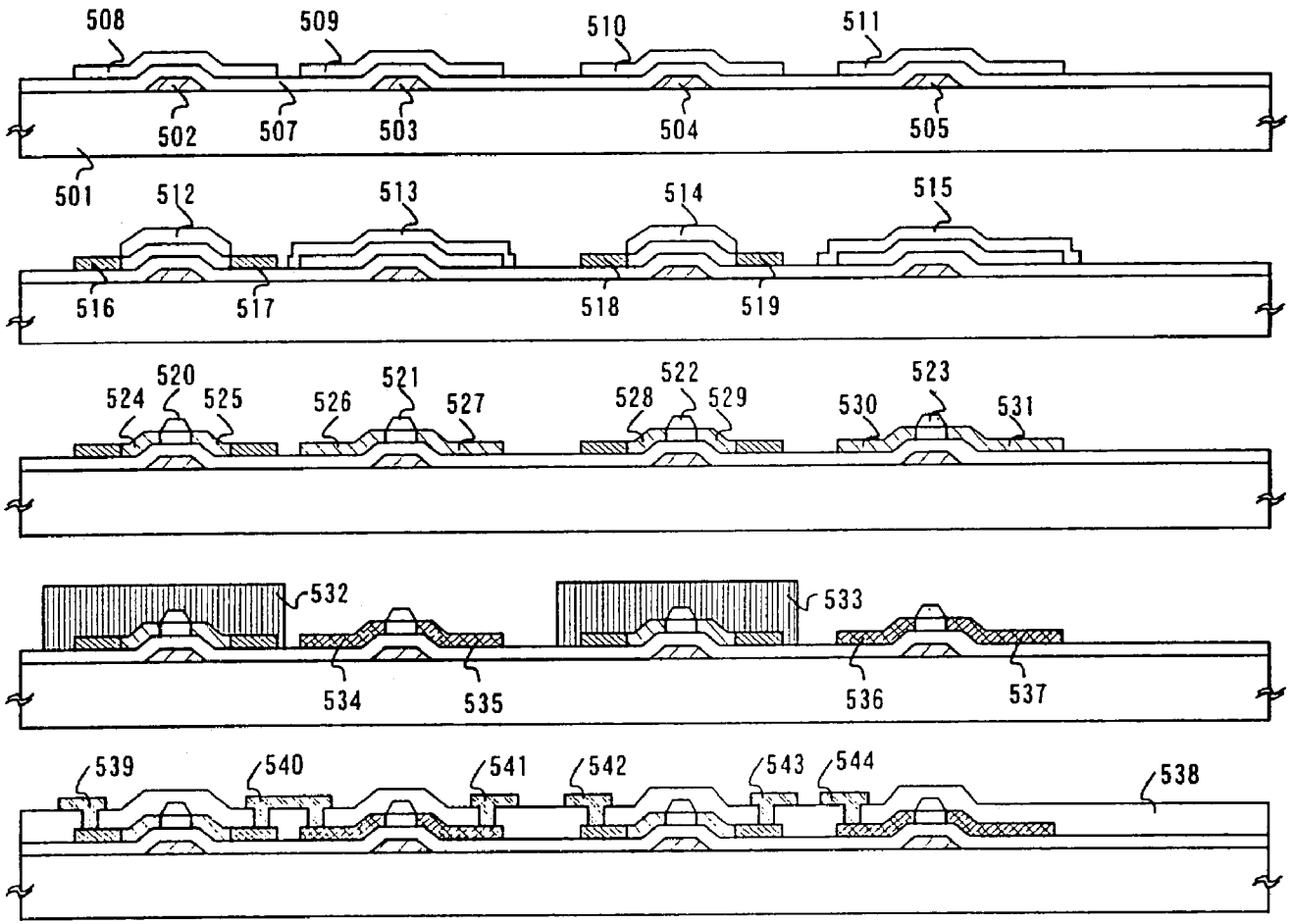
FIGS. 19A to 19E are diagrams showing a process of manufacturing an EL display device according to the present invention.

Referring to FIGS. 19A to 19E, gate electrodes 502 to 505 are first formed from a chromium film on a glass substrate 501. A silicon oxynitride film (an insulating film of SiOxNy) is used to form a gate insulating film 507 on the gate electrodes. On the gate insulating film 507, an amorphous silicon film is formed and crystallized by laser annealing. The crystallized film is patterned to form semiconductor films 508 to 511 that are crystalline silicon films. The steps up through this point can be carried out with known materials and known techniques. (FIG. 19A)

Next, insulating films 512 to 515 are formed from a silicon oxide film on the semiconductor films 508 to 511. The semiconductor films are doped with phosphorus or arsenic through the insulating films. A known technique can be used as the doping method. As a result, n type impurity regions 516 to 519 are formed. The n type impurity regions 516 to 519 contain phosphorus or arsenic in a concentration of $1\times10^{20}$ to $1\times10^{21}$ atoms/cm$^3$. (FIG. 19B)

Using the gate electrodes 502 to 505 as masks, the insulating films 512 to 515 are patterned by back side exposure to form insulating films (channel protection films) 520 to 523. In this state, doping of phosphorus or arsenic is again conducted by a known technique. As a result, n type impurity regions 524 to 531 are formed. The n type impurity regions 524 to 531 contain phosphorus or arsenic in a concentration of $1\times10^{17}$ to $1\times10^{19}$ atoms/cm$^3$. (FIG. 19C)

Then resist masks 532 and 533 are formed to conduct doping of boron by a known technique. As a result, p type impurity regions 534 to 537 are formed. The p type impurity regions 534 to 537 contain boron in a concentration of $3\times10^{20}$ to $5\times10^{21}$ atoms/cm$^3$. Although the p type impurity regions 534 to 537 have already been doped with phosphorus or arsenic, now that they are doped with boron in a concentration 3 times the phosphorus or arsenic concentration or more, the conductivity of the regions 534 to 537 is shifted from n type to p type completely. (FIG. 19D)

The resist masks 532 and 533 are then removed, and a first interlayer insulating film 538 having a laminate structure of a silicon oxide film and a silicon oxynitride film is formed. A contact hole is formed in the first interlayer insulating film 538 to form wirings 539 to 544 in which a molybdenum film and a tungsten film are layered. (FIG. 19E)

Figure 20:
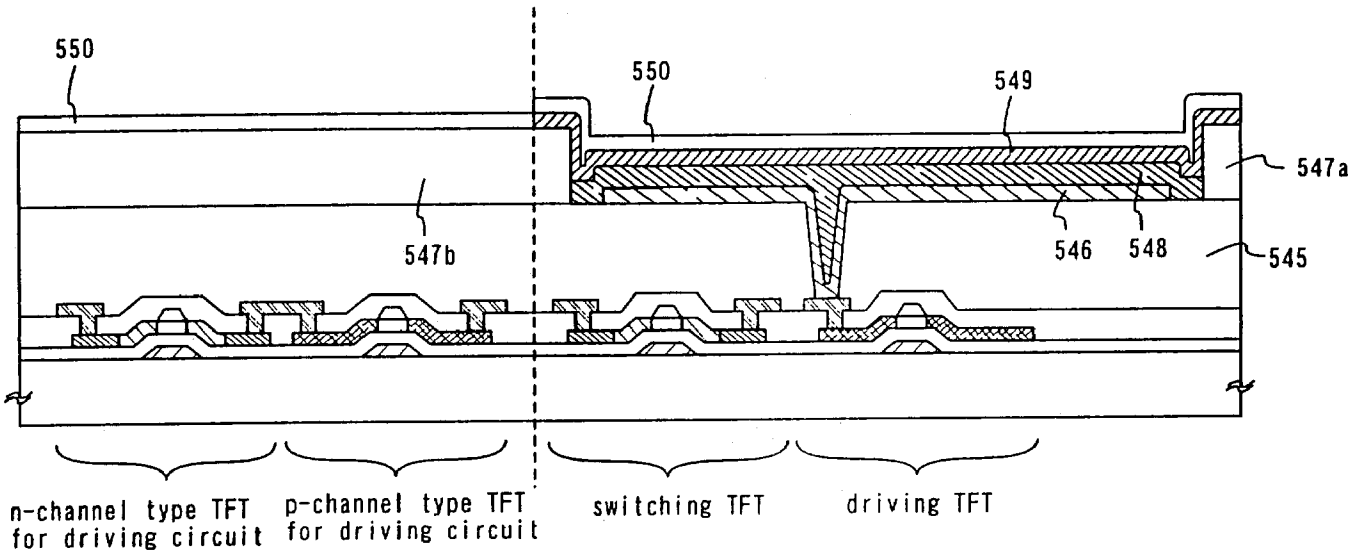
FIG. 20 is a diagram showing the process of manufacturing the EL display device according to the present invention.

Thereafter, a second interlayer insulating film 545, a pixel electrode 546, banks 547*a* and 547*b*, an EL layer 548, a cathode 549 and a protective film 550 are formed as shown in FIG. 20. A light emitting device having the sectional structure of FIG. 20 is thus completed.

This embodiment can be carried out in combination with either Embodiment 1 or Embodiment 2 without restriction.

Embodiment 4

Figure 9A:
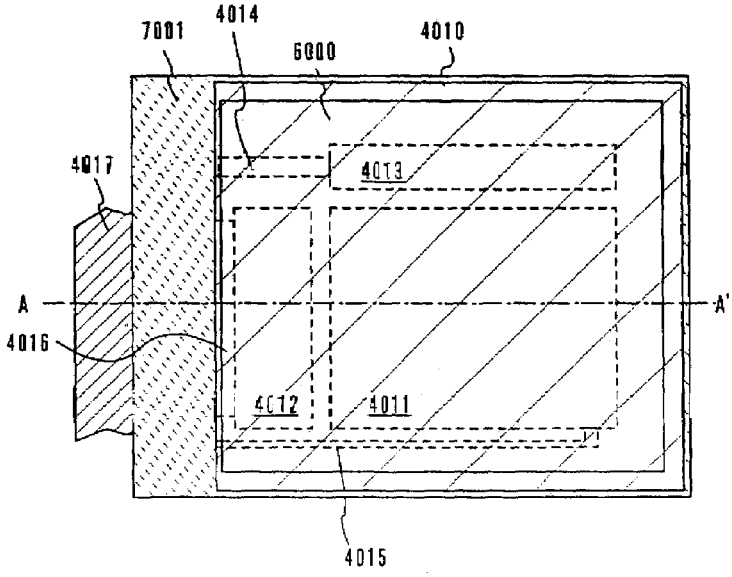
FIGS. 9A and 9B are a top view of an EL display device according to the present invention and a sectional view thereof, respectively.
Figure 9B:
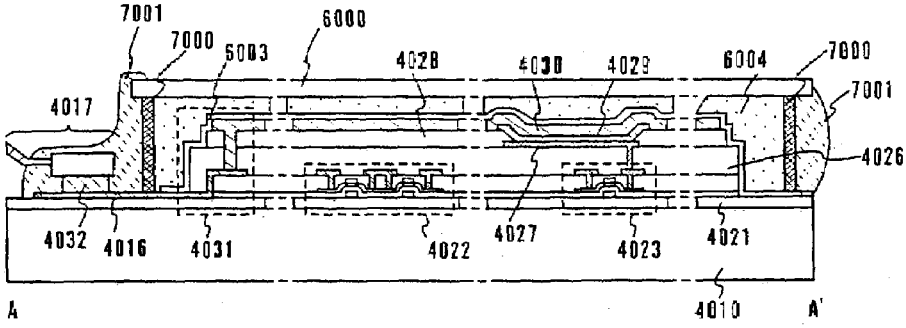

FIG. 9A is a top view of an EL display device using the present invention. FIG. 9B shows a cross-sectional view in which FIG. 9A is cut along the line A–A'.

In FIG. 9A, reference numeral 4010 is a substrate, reference numeral 4011 is a pixel portion, reference numeral 4012 is a source signal side driver circuit, and reference numeral 4013 is a gate signal side driver circuit. The driver circuits are connected to external equipment, through an FPC 4017, via wirings 4014 and 4016. Reference numeral 4015 is a wiring for the power source supply line.

A covering material 6000, a sealing material (also referred to as a housing material) 7000, and an airtight sealing material (a second sealing material) 7001 are formed so as to enclose at least the pixel portion, preferably the driver circuits and the pixel portion, at this point.

Further, FIG. 9B is a cross sectional structure of the EL display device of the present invention. A driver circuit TFT 4022 (note that a CMOS circuit in which an n-channel TFT and a p-channel TFT are combined is shown in the figure here), a pixel portion TFT 4023 (note that only a driver TFT for controlling the current flowing to an EL element is shown here) are formed on a base film 4021 on a substrate 4010. The TFTs may be formed using a known structure (a top gate structure or a bottom gate structure).

After the driver circuit TFT 4022 and the pixel portion TFT 4023 are completed, a pixel electrode 4027 is formed on an interlayer insulating film (leveling film) 4026 made from a resin material. The pixel electrode is formed from a transparent conducting film for electrically connecting to a drain of the pixel TFT 4023. An indium oxide and tin oxide compound (referred to as ITO) or an indium oxide and zinc oxide compound can be used as the transparent conducting film. An insulating film 4028 is formed after forming the pixel electrode 4027, and an open portion is formed on the pixel electrode 4027.

An EL layer 4029 is formed next. The EL layer 4029 may be formed having a lamination structure, or a single layer structure, by freely combining known EL materials (such as a hole injecting layer, a hole transporting layer, a light emitting layer, an electron transporting layer, and an electron injecting layer). A known technique may be used to determine which structure to use. Further, EL materials exist as low molecular weight materials and high molecular weight (polymer) materials. Evaporation is used when using a low molecular weight material, but it is possible to use easy methods such as spin coating, printing, and ink jet printing when a high molecular weight material is employed.

In embodiment 4, the EL layer is formed by evaporation using a shadow mask. Color display becomes possible by forming emitting layers (a red color emitting layer, a green color emitting layer, and a blue color emitting layer), capable of emitting light having different wavelengths, for each pixel using a shadow mask. In addition, methods such as a method of combining a charge coupled layer (CCM) and color filters, and a method of combining a white color light emitting layer and color filters may also be used. Of course, the EL display device can also be made to emit a single color of light.

After forming the EL layer 4029, a cathode 4030 is formed on the EL layer. It is preferable to remove as much as possible any moisture or oxygen existing in the interface between the cathode 4030 and the EL layer 4029. It is therefore necessary to use a method of depositing the EL layer 4029 and the cathode 4030 in an inert gas atmosphere or within a vacuum. The above film deposition becomes possible in embodiment 4 by using a multi-chamber method (cluster tool method) film deposition apparatus.

Note that a lamination structure of a LiF (lithium fluoride) film and an Al (aluminum) film is used in embodiment 3 as the cathode 4030. Specifically, a 1 nm thick LiF (lithium fluoride) film is formed by evaporation on the EL layer 4029, and a 300 nm thick aluminum film is formed on the LiF film. An MgAg electrode, a known cathode material, may of course also be used. The wiring 4016 is then connected to the cathode 4030 in a region denoted by reference numeral 4031. The wiring 4016 is an electric power supply line for imparting a predetermined voltage to the cathode 4030, and is connected to the FPC 4017 through a conducting paste material 4032.

In order to electrically connect the cathode 4030 and the wiring 4016 in the region denoted by reference numeral 4031, it is necessary to form a contact hole in the interlayer insulating film 4026 and the insulating film 4028. The contact holes may be formed at the time of etching the interlayer insulating film 4026 (when forming a contact hole for the pixel electrode) and at the time of etching the insulating film 4028 (when forming the opening portion before forming the EL layer). Further, when etching the insulating film 4028, etching may be performed all the way to the interlayer insulating film 4026 at one time. A good contact hole can be formed in this case, provided that the interlayer insulating film 4026 and the insulating film 4028 are the same resin material.

A passivation film 6003, a filling material 6004, and the covering material 6000 are formed covering the surface of the EL element thus made.

In addition, the sealing material 7000 is formed between the covering material 6000 and the substrate 4010, so as to surround the EL element portion, and the airtight sealing material (the second sealing material) 7001 is formed on the outside of the sealing material 7000.

The filling material 6004 functions as an adhesive for bonding the covering material 6000 at this point. PVC (polyvinyl chloride), epoxy resin, silicone resin, PVB (polyvinyl butyral), and EVA (ethylene vinyl acetate) can be used as the filling material 6004. If a drying agent is formed on the inside of the filling material 6004, then it can continue to maintain a moisture absorbing effect, which is preferable.

Further, spacers may be contained within the filling material 6004. The spacers may be a powdered substance such as BaO, giving the spacers themselves the ability to absorb moisture.

When using spacers, the passivation film 6003 can relieve the spacer pressure. Further, a film such as a resin film can be formed separately from the passivation film 6003 to relieve the spacer pressure.

Furthermore, a glass plate, an aluminum plate, a stainless steel plate, an FRP (fiberglass-reinforced plastic) plate, a PVF (polyvinyl fluoride) film, a Mylar film, a polyester film, and an acrylic film can be used as the covering material 6000. Note that if PVB or EVA is used as the filling material 6004, it is preferable to use a sheet with a structure in which several tens of aluminum foil is sandwiched by a PVF film or a Mylar film.

However, depending upon the light emission direction from the EL element (the light radiation direction), it is necessary for the covering material 6000 to have light transmitting characteristics.

Further, the wiring 4016 is electrically connected to the FPC 4017 through a gap between the sealing material 7001 and the substrate 4010. Note that although an explanation of the wiring 4016 has been made here, the wirings 4014 and 4015 are also electrically connected to the FPC 4017 by similarly passing underneath the sealing material 7001 and sealing material 7000.

In FIGS. 9A and 9B, the covering material 6000 is bonded after forming the filling material 6004, and the sealing material 7000 is attached so as to cover the lateral surfaces (exposed surfaces) of the filling material 6004, but the filling material 6004 may also be formed after attaching the covering material 6000 and the sealing material 7000. In this case, a filling material injection opening is formed through a gap formed by the substrate 4010, the covering material 6000, and the sealing material 7000. The gap is set into a vacuum state (a pressure equal to or less than $10^{-2}$ Torr), and after immersing the injection opening in the tank holding the filling material, the air pressure outside of the gap is made higher than the air pressure within the gap, and the filling material fills the gap.

Note that it is possible to implement the constitution of embodiment 4 by freely combining it with the constitution of embodiment 1 to embodiment 3.

Embodiment 5

Figure 10A:
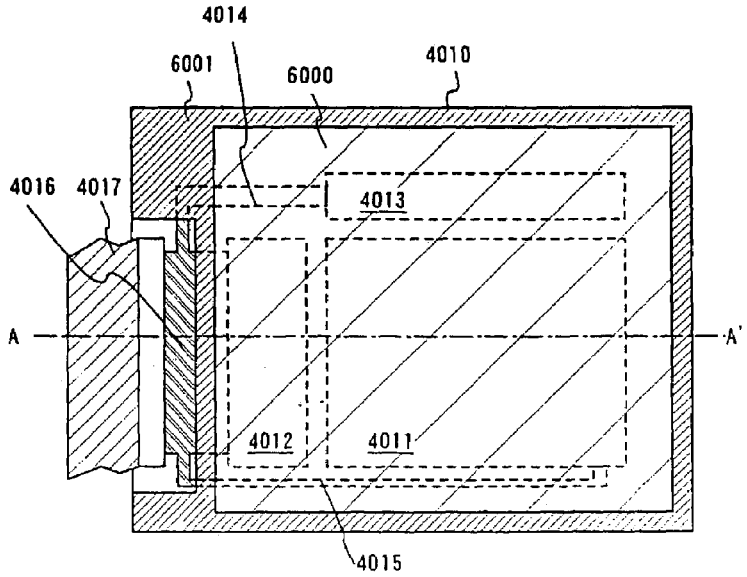
FIGS. 10A and 10B are a top view of an EL display device according to the present invention and a sectional view thereof, respectively.
Figure 10B:
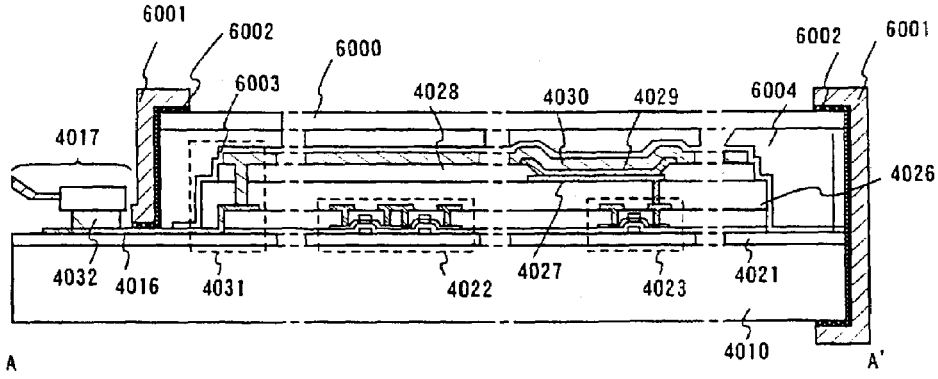

Next, an example of manufacturing an EL display device having a structure which differs from that of FIGS. 9A and 9B is explained using FIGS. 10A and 10B. Parts having the same reference numerals as those of FIGS. 9A and 9B indicate the same portions, and therefore an explanation of those parts is omitted.

FIG. 10A is a top view of an EL display device of embodiment 5, and FIG. 10B shows a cross sectional diagram in which FIG. 10A is cut along the line A–A'.

In accordance with FIGS. 9A and 9B, manufacturing is performed through the step of forming the passivation film 6003 covering the EL element.

In addition, the filling material 6004 is formed so as to cover the EL element. The filling material 6004 also functions as an adhesive for bonding the covering material 6000. PVC (polyvinyl chloride), epoxy resin, silicone resin, PVB (polyvinyl butyral), and EVA (ethylene vinyl acetate) can be used as the filling material 6004. If a drying agent is provided on the inside of the filling material 6004, then it can continue to maintain a moisture absorbing effect, which is preferable.

Further, spacers may be contained within the filling material 6004. The spacers may be a powdered substance such as BaO, giving the spacers themselves the ability to absorb moisture.

When using spacers, the passivation film 6003 can relieve the spacer pressure. Further, a film such as a resin film can be formed separately from the passivation film 6003 to relieve the spacer pressure.

Furthermore, a glass plate, an aluminum plate, a stainless steel plate, an FRP (fiberglass-reinforced plastic) plate, a PVF (polyvinyl fluoride) film, a Mylar film, a polyester film, and an acrylic film can be used as the covering material 6000. Note that if PVB or EVA is used as the filler material 6004, it is preferable to use a sheet with a structure in which several tens of aluminum foil is sandwiched by a PVF film or a Mylar film.

However, depending upon the light emission direction from the EL element (the light radiation direction), it is necessary for the covering material 6000 to have light transmitting characteristics.

After bonding the covering material 6000 using the filling material 6004, the frame material 6001 is attached so as to cover the lateral surfaces (exposed surfaces) of the filling material 6004. The frame material 6001 is bonded by the sealing material (which functions as an adhesive) 6002. It is preferable to use a light hardening resin as the sealing material 6002 at this point, but provided that the heat resistance characteristics of the EL layer permit a thermal hardening resin may also be used. Note that it is preferable that the sealing material 6002 be a material which, as much as possible, does not transmit moisture and oxygen. Further, a drying agent may also be added to an inside portion of the sealing material 6002.

The wiring 4016 is electrically connected to the FPC 4017 through a gap between the sealing material 6002 and the substrate 4010. Note that although an explanation of the wiring 4016 has been made here, the wirings 4014 and 4015 are also electrically connected to the FPC 4017 by similarly passing underneath the sealing material 6002.

Note that the covering material 6000 is bonded, and the frame material 6001 is attached so as to cover the lateral surfaces (exposed surfaces) of the filling material 6004, after forming the filling material 6004 in FIGS. 10A and 10B, but the filling material 6004 may also be formed after attaching the covering material 6000 and the frame material 6001. In this case, a filling material injection opening is formed through a gap formed by the substrate 4010, the covering material 6000, and the frame material 6001. The gap is set into a vacuum state (a pressure equal to or less than $10^{-2}$ Torr), and after immersing the injection opening in the tank holding the filling material, the air pressure outside of the gap is made higher than the air pressure within the gap, and the filling material fills the gap.

Note that it is possible to implement the constitution of embodiment 5 by freely combining it with the constitution of embodiment 1 to embodiment 3.

Embodiment 6

Figure 11:
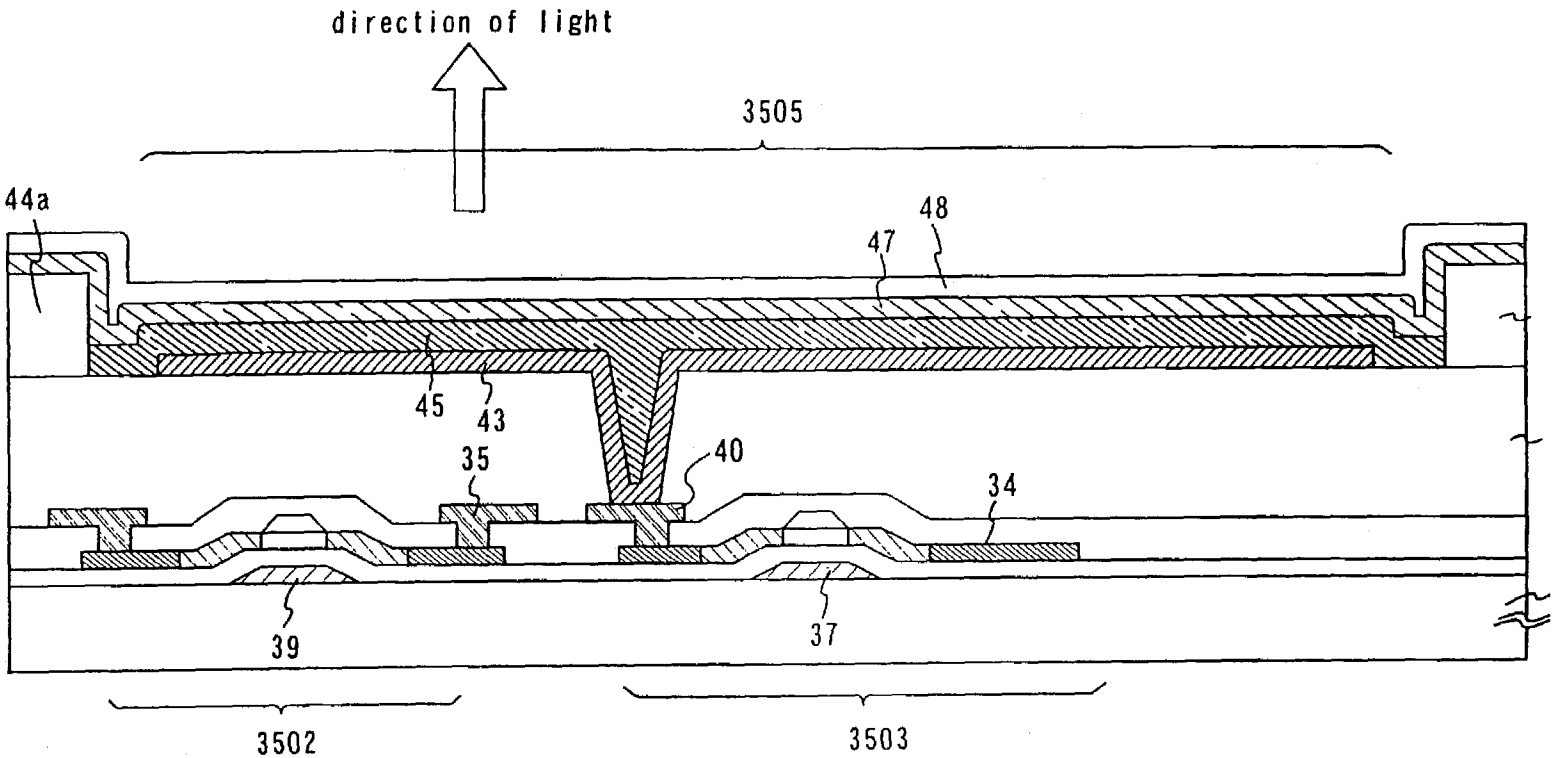
FIG. 11 is a sectional view of an EL display device according to the present invention.

A more detailed cross sectional structure of a pixel portion is shown here in FIG. 11.

A switching TFT 3502 formed on a substrate 3501 is manufactured by using a known method in FIG. 11. A single gate structure is used in embodiment 6. Note that although a single gate structure is used in embodiment 6, a double gate structure, a triple gate structure, and a multi gate structure possessing a greater number of gates may also be used.

A single gate structure of the driver TFT 3503 is shown in the figures in embodiment 6, but a multi-gate structure in which a plurality of TFTs are connected in series may also be used. In addition, a structure in which a plurality of TFTs are connected in parallel, effectively partitioning into a plurality of channel forming regions, and which can perform radiation of heat with high efficiency, may also be used. Such structure is effective as a countermeasure against deterioration due to heat.

In this embodiment, an explanation is given in the case that the switching TFT and the driver TFT are both n-channel TFT.

The driver TFT 3503 is formed by a known method. The drain wiring 35 of the switching TFT 3502 is connected electrically to the gate wiring 37 of the driver TFT 3503. The drain wiring 40 of the driver TFT 3503 is connected to the cathode 43 of EL element. Furthermore, a source region 34 of the driver TFT 3503 is connected to an electric power supply line (not shown in the figures), and a constant voltage is always applied.

A leveling film 42 from an insulating resin film is formed on the switching TFT 3502 and the driver TFT 3503. It is extremely important to level the step due to the TFTs using the leveling film 42. An EL layer formed later is extremely thin, so there are cases in which defective light emissions occur. Therefore, to form the EL layer with as level a surface as possible, it is preferable to perform leveling before forming a pixel electrode.

Furthermore, reference numeral 43 denotes a pixel electrode (EL element cathode) made from a conducting film with high reflectivity, and this is electrically connected to a drain region 40 of the driver TFT 3503. It is preferable to use a low resistance conducting film, such as an aluminum alloy film, a copper alloy film, and a silver alloy film, or a laminate of such films. Of course, a lamination structure with another conducting film may also be used.

In addition, a light emitting layer 45 is formed in the middle of a groove (corresponding to a pixel) formed by banks 44*a* and 44*b*, which are formed by insulating films (preferably resins). Note that only one pixel is shown in the figures here, but the light emitting layer may be divided to correspond to each of the colors R (red), G (green), and B (blue). A π-conjugate polymer material is used as an organic EL material. Polyparaphenylene vinylenes (PPVs), polyvinyl carbazoles (PVKs), and polyfluoranes can be given as typical polymer materials.

Note that there are several types of PPV organic EL materials, and materials recorded in Schenk, H., Becker, H., Gelsen, O., Kluge, E., Kreuter, W., and Spreitzer, H., "Polymers for Light Emitting Diodes," Euro Display Proceedings, 1999, pp. 33–7, and in Japanese Patent Application Laidopen No. Hei 10-92576, for example, may be used. The entire disclosures of these article and patent are incorporated herein by reference.

As specific light emitting layers, cyano-polyphenylene vinylene may be used as a red light radiating luminescence layer, polyphenylene vinylene may be used as a green light radiating luminescence layer, and polyphenylene vinylene or polyalkylphenylene may be used as a blue light radiating luminescence layer. The film thicknesses may be between 30 and 150 nm (preferably between 40 and 100 nm).

However, the above example is one example of the organic EL materials which can be used as luminescence layers, and it is not necessary to limit use to these materials. An EL layer (a layer for emitting light and for performing carrier motion for such) may be formed by freely combining light emitting layers, electric charge transporting layers, and electric charge injecting layers.

For example, embodiment 6 shows an example of using a polymer material as a light emitting layer, but a low molecular weight organic EL material may also be used. Further, it is possible to use inorganic materials such as silicon carbide, as an electric charge transporting layer or an electric charge injecting layer. Known materials can be used for these organic EL materials and inorganic materials.

An anode 47 is then formed on the light emitting layer 45 from a transparent conducting film. The light generated by the light emitting layer 45 is radiated toward the upper surface (toward the reverse direction to the substrate on which is formed TFT) in embodiment 6, and therefore the anode must be transparent to light. An indium oxide and tin oxide compound, or an indium oxide and zinc oxide compound can be used for the transparent conducting film. However, because it is formed after forming the low heat resistance light emitting and hole injecting layers, it is preferable to use a material which can be deposited at as low a temperature as possible.

An EL element 3505 is complete at the point where the anode 47 is formed. Note that what is called the EL element 3505 here is formed by the pixel electrode (cathode) 43, the light emitting layer 45, and the anode 47. The pixel electrode 43 is nearly equal in area to the pixel, and consequently the entire pixel functions as an EL element. Therefore, the light emitting efficience is extremely high, and a bright image display becomes possible. In addition, a second passivation film 48 is then formed on the anode 47 in embodiment 6.

It is preferable to use a silicon nitride film or a silicon oxynitride film as the second passivation film 48. The purpose of this is the isolation of the EL element from the outside, and this is meaningful in preventing degradation due to oxidation of the organic EL material, and in controlling gaseous emitted from the organic EL material. The reliability of the EL display device can thus be raised Note that n-channel TFTs and p-channel TFTs may be used for the driver TFT. However, in a case the anode of the EL element is an opposite electrode and the cathode of the EL element is a pixel electrode, it is preferable that the driver TFT be an n-channel TFT. Note that it is possible to implement the constitution of embodiment 6 by freely combining it with the constitutions of any of embodiments 1 to 5.

Embodiment 7

This embodiment gives a description on the structure obtained by inverting the structure of the EL element 3505 in the pixel portion shown in Embodiment 6. The description will be given with reference to FIG. 12. The structure of this embodiment is different from the structure of FIG. 11 described in Embodiment 6 regarding only with the EL element and a driving TFT. The same components as those in FIG. 11 are denoted by the same reference symbols and explanations thereof will be omitted.

In this embodiment, a switching TFT may be an n-channel TFT or a p-channel TFT and the same applies to a driving TFT. However, the driving TFT is desirably a p-channel TFT if a pixel electrode of an EL element is an anode.

Figure 12:
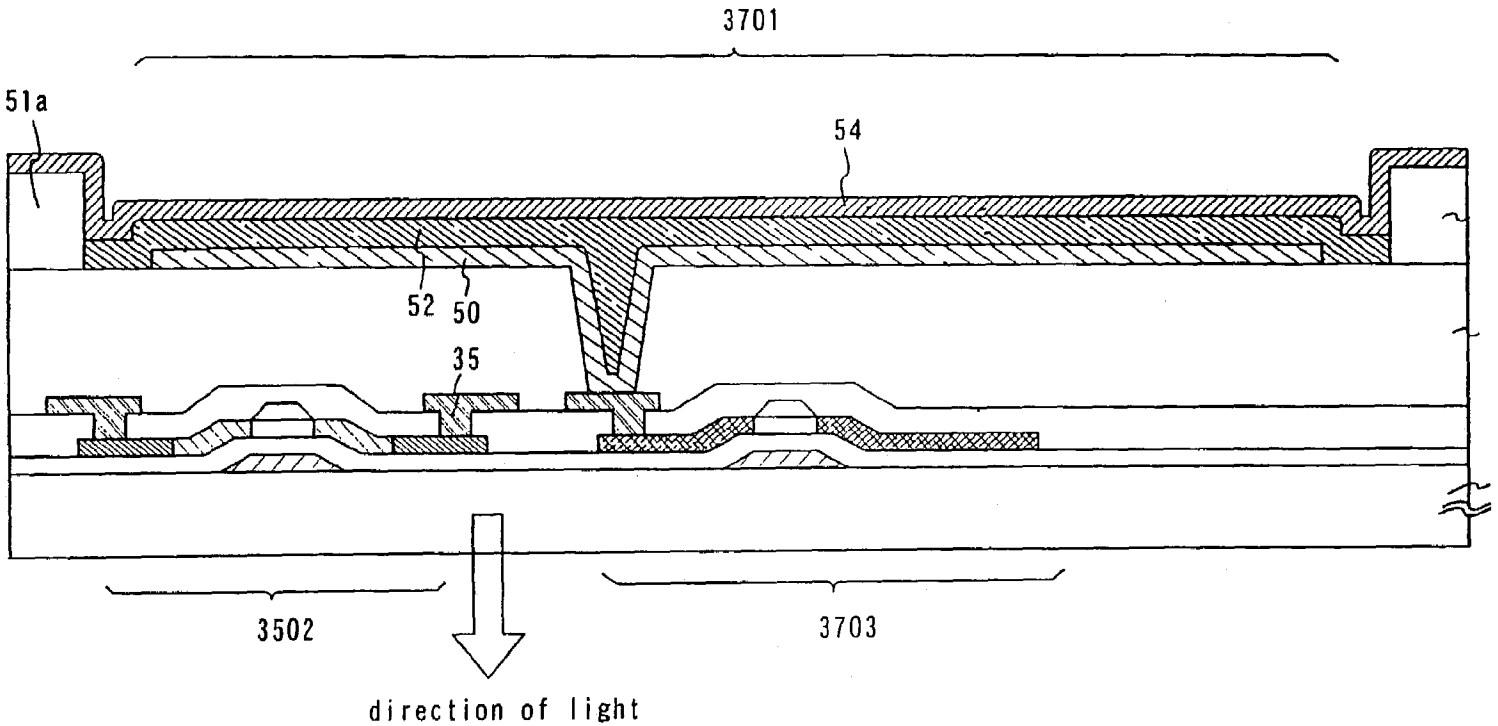
FIG. 12 is a sectional view of an EL display device according to the present invention.

In FIG. 12, a driving TFT 3703 is a p-channel TFT and can be manufactured by using a known method. The driving TFT 3703 of this embodiment has a drain wiring 55 connected to an anode 50 of an EL element 3701. The driving TFT 3703 has a source region 56 connected to a power supply line (not shown).

A switching TFT 3502 here is an n-channel TFT. A gate electrode 57 of the driving TFT 3703 is electrically connected to a drain wiring 35 of the switching TFT 3502.

A transparent conductive film is used for the pixel electrode (anode) 50 in this embodiment. Specifically, the film used is a conductive film containing a compound of indium oxide and zinc oxide. A conductive film containing a compound of indium oxide and tin oxide may of course be used instead.

After forming banks 51*a* and 51*b* from an insulating film, a light emitting layer 52 is formed from polyvinyl carbazole by solution coating. On the light emitting layer, a cathode 54 is formed from an aluminum alloy. In this case, the cathode 54 also functions as a passivation film. The EL element 3701 is thus completed.

In the case of this embodiment, light generated in the light emitting layer 52 is emitted toward a substrate on which the TFTs are formed as indicated by the arrow.

This embodiment can be combined freely with Embodiments 1 through 5.

Embodiment 8

This embodiment describes the structure of a source signal line driving circuit.

The source signal line driving circuit is fabricated by forming a bottom gate TFT on an insulating substrate through a process as the one shown in Embodiment 3.

With reference to a circuit diagram of FIG. 15, a case will first be described in which the divided source signal line driving circuit shown in FIG. 17 in accordance with Embodiment Mode 2 of the present invention is actually constructed using elements.

This is an example of the case where a digital video signal is inputted from the external to the source signal line driving circuit to output the digital signal to a source signal line.

Figure 15:
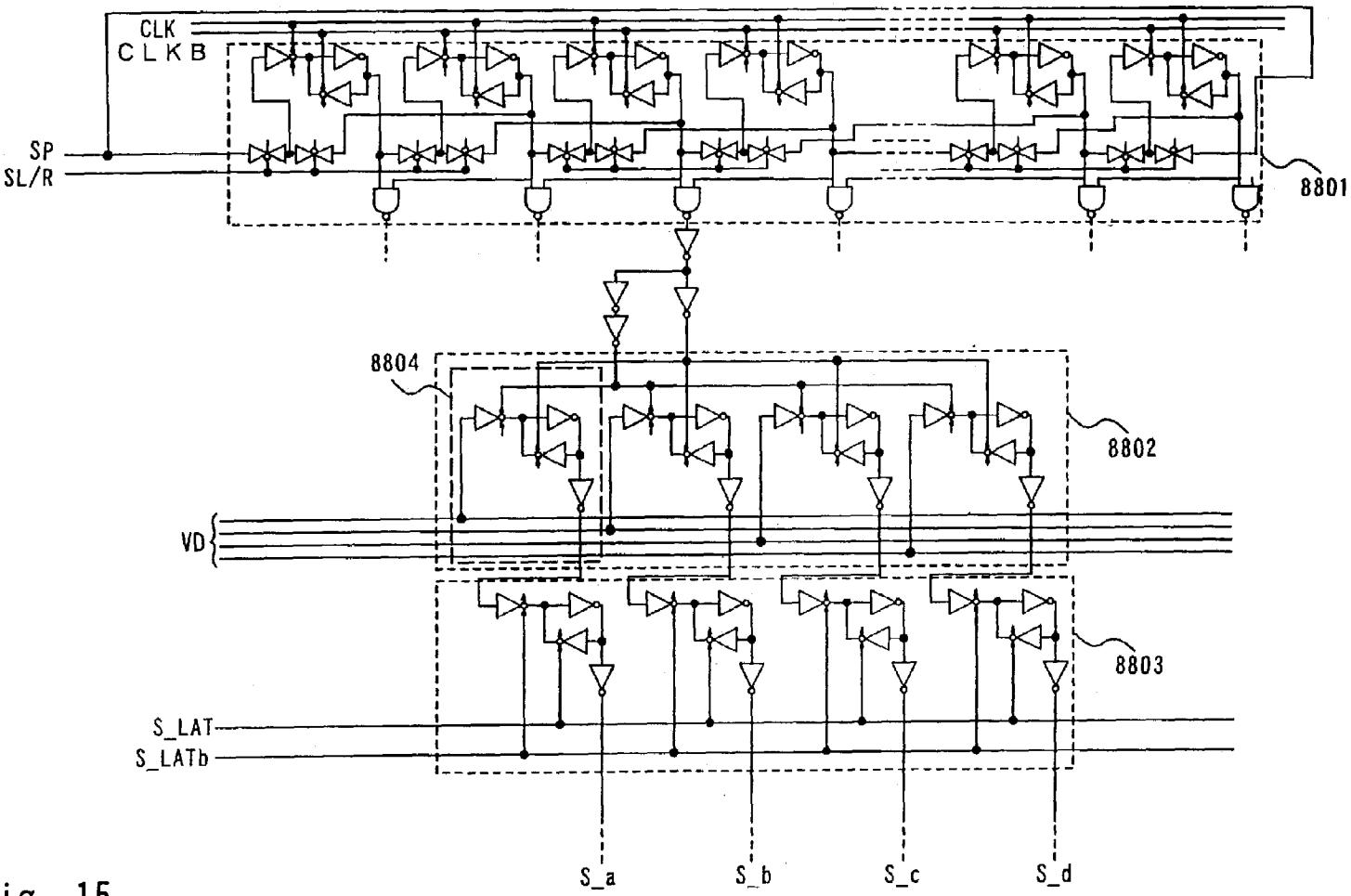
FIG. 15 is a circuit diagram showing a source signal line driving circuit of an EL display device according to the present invention.

FIG. 15 focuses on a latch (A) and a latch (B) in one block.

A shift register 8801, latches (A) 8802 and latches (B) 8803 are arranged as shown in FIG. 15. A pair of latches (A) 8802 and a pair of latches (B) 8803 are associated with four source signal lines S_a to S_d.

The description given in this embodiment is of a case where a digital video signal is divided into four parts and then inputted, so that the four signals are sampled at the same time. However, the present invention is not limited to this case and the signal may be divided into k parts (k is an arbitrary integer greater than 1) to sample the k signals.

A level shifter, a buffer or the like for changing the amplitude of the voltage of a signal is not provided in this embodiment. However, it may be provided if a designer finds it suitable.

A clock signal CLK, a clock signal CLKB obtained by inverting the polarity of CLK, a start pulse signal SP, and a drive direction switching signal SL/R are inputted to the shift register 8801 from their respective wirings shown in FIG. 15. A digital data signal VD inputted from the external is subjected to time base expansion and divided into four parts, which are inputted to the latches (A) 8802 from the wirings shown in FIG. 15. A latch signal S_LAT and a signal S_LATb obtained by inverting the polarity of S_LAT are inputted to the latches (B) 8803 from their respective wirings shown in FIG. 15.

With an input of a signal from the shift register 8801, the latches (A) 8802 receive from signal lines of digital data divided into four parts the four parts of the digital data signal VD to sample the four signals simultaneously and hold them in. In response to input of the latch signal S_LAT and the signal S_LATb, the signals held in the latches (A) are sent to the latches (B) 8803 all at once to be outputted to the source signal lines S_a to S_d.

Details of the structure of the latches (A) 8802 will be described taking as an example a portion 8804 that is a part of the latches (A) 8802 and associated with the source signal line S_a. The portion 8804 that is a part of the latches (A) 8802 has two clocked inverters and two inverters.

Figure 16:
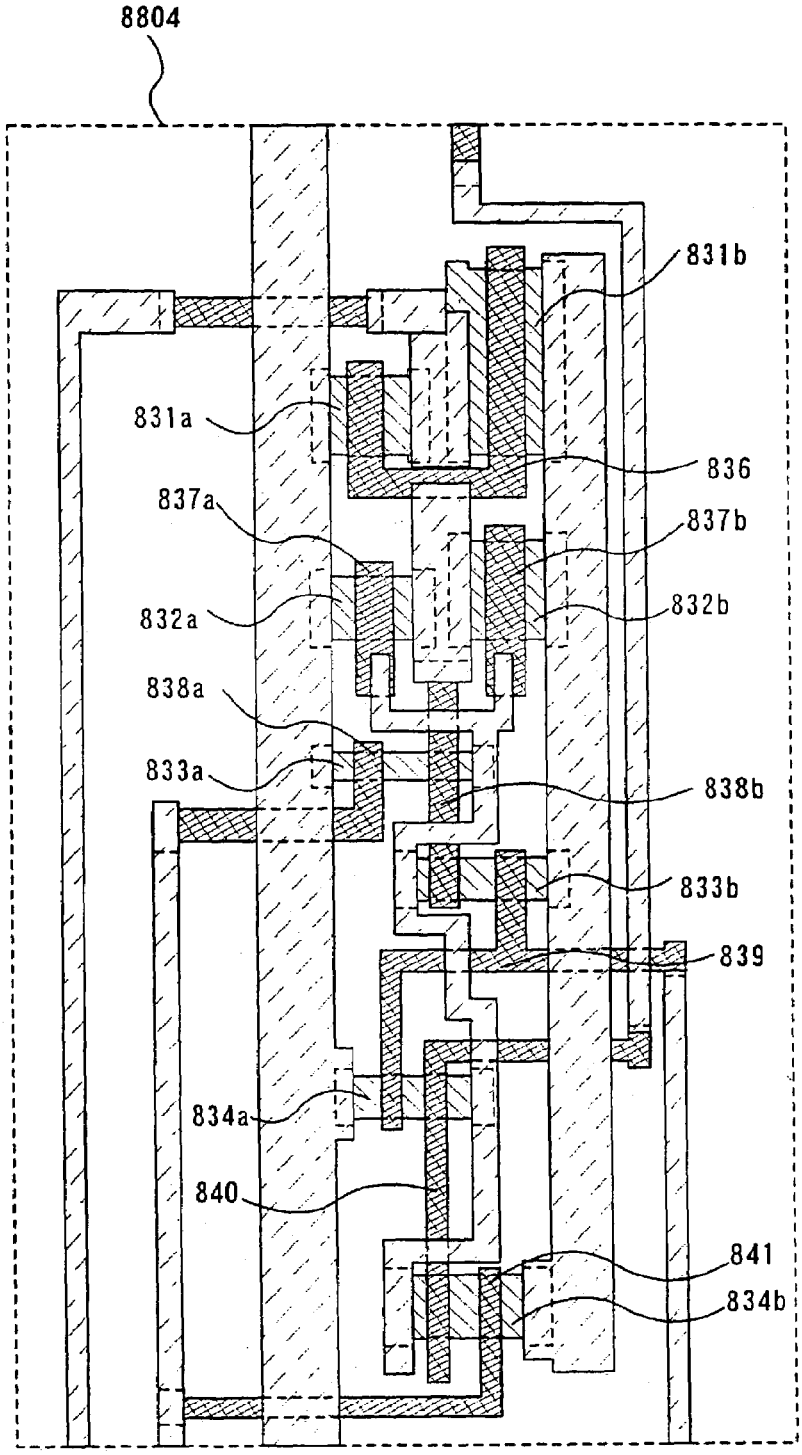
FIG. 16 is a top view of a latch of an EL display device according to the present invention.

FIG. 16 shows a top view of the portion 8804 that is a part of the latches (A) 8802. Denoted by 831*a* and 831*b* are active layers of TFTs that constitute one of the inverters of the portion 8804 that is a part of the latches (A) 8802. Reference symbol 836 denotes a common gate electrode of the TFTs constituting the one inverter. The other inverter of the portion 8804 that is a part of the latches (A) 8802 is composed of TFTs whose active layers are denoted by 832*a* and 832*b*. On the active layers 832*a* and 832*b*, gate electrodes 837*a* and 837*b* are provided. The gate electrodes 837*a* and 837*b* are electrically connected to each other.

Denoted by 833*a* and 833*b* are active layers of TFTs that constitute one of the clocked inverters of the portion 8804 that is a part of the latches (A) 8802. On the active layer 833*a*, gate electrodes 838*a* and 838*b* are formed to provide a double gate structure. On the active layer 833*b*, the gate electrode 838*b* and a gate electrode 839 are formed to provide a double gate structure.

Denoted by 834*a* and 834*b* are active layers of TFTs that constitute the other clocked inverter of the portion 8804 that is a part of the latches (A) 8802. On the active layer 834*a*, the gate electrode 839 and a gate electrode 840 are formed to provide a double gate structure. On the active layer 834*b*, the gate electrode 840 and a gate electrode 841 are formed to provide a double gate structure.

The next description is of the structure of the divided source signal line driving circuit in the case of using an analog method.

The analog method refers to a method in which the luminance of pixels is varied by inputting an analog signal into a source signal line in a display device. The description given here deals with a case where an analog signal is inputted to a source signal line driving circuit to output the analog signal to a source signal line.

Figure 21:
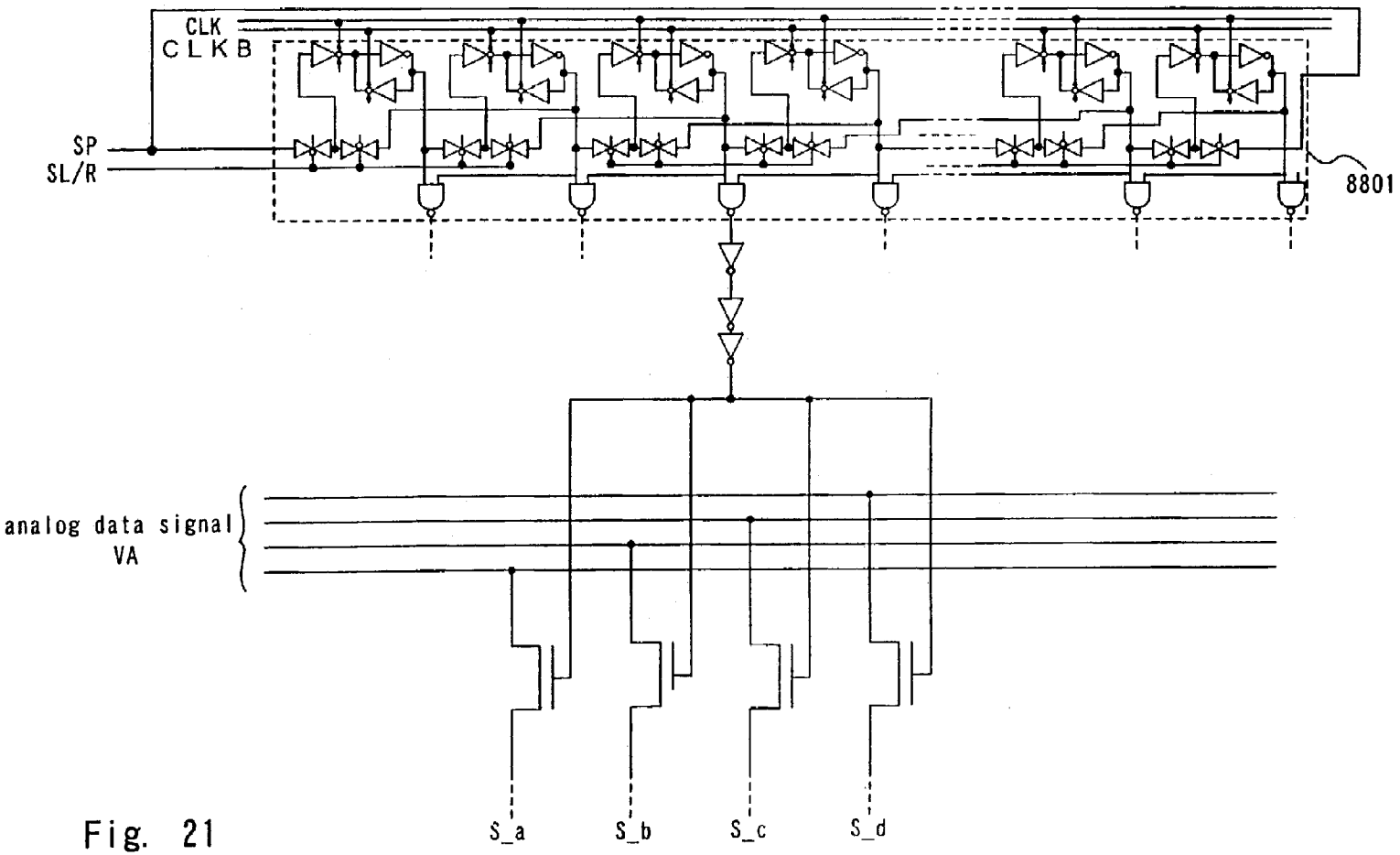
FIG. 21 is a circuit diagram showing a source signal line driving circuit of an EL display device according to the present invention.

FIG. 21 shows an example of the source signal line driving circuit employing the analog method.

Similar to the above sampling of digital data signals, plural parts of an analog data signal VA which have been subjected to time base expansion are inputted from four wirings in FIG. 21.

FIG. 21 focuses on one block in the source signal line driving circuit with the block associated with outputs of signal lines S_a to S_d.

A signal sent from a shift register 8801 simultaneously turns TFTs 2101*a* to 2101*d* ON, starting simultaneous sampling of four parts of the analog data signal VA.

The description given in this embodiment is of the case where four parts of the analog data signal VA which are to be inputted to four source signal lines are sampled at once. However, the source signal line driving circuit of a display device according to the present invention is not limited thereto. To elaborate, the invention can use a source signal line driving circuit in which the analog data signal VA is divided into arbitrary number of parts that are to be inputted to the same number of source signal lines and the parts are sampled at the same time.

Figure 22A:
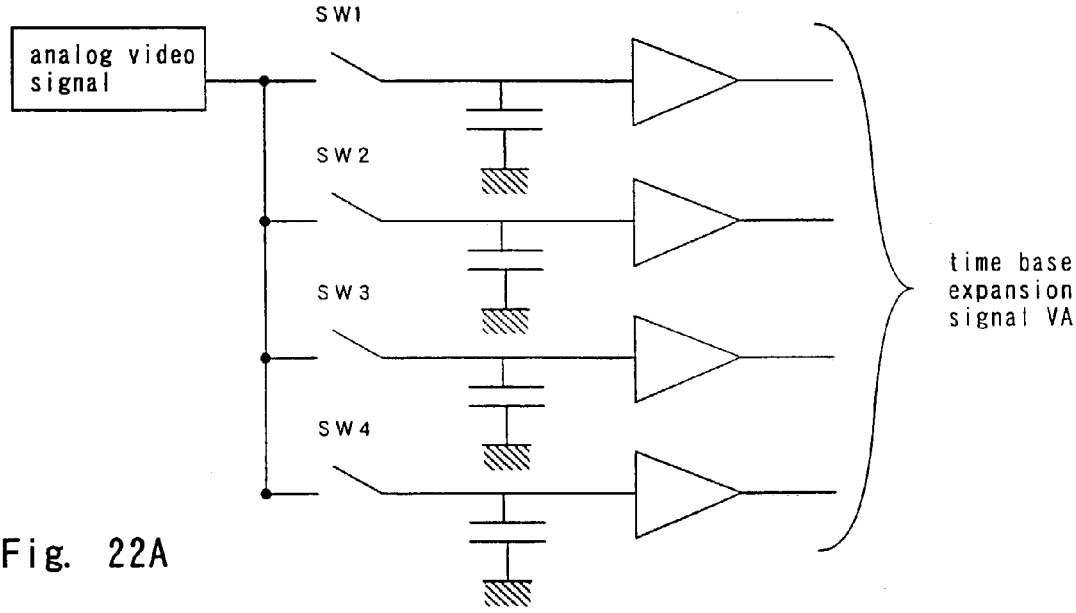
FIG. 22 is a circuit diagram showing a time base expansion signal circuit of an EL display device according to the present invention.

FIG. 22A shows an example of a circuit for subjecting an analog video signal to time base expansion so as to generate the analog data signal VA (hereinafter referred to as time base expansion circuit).

Figure 22B:
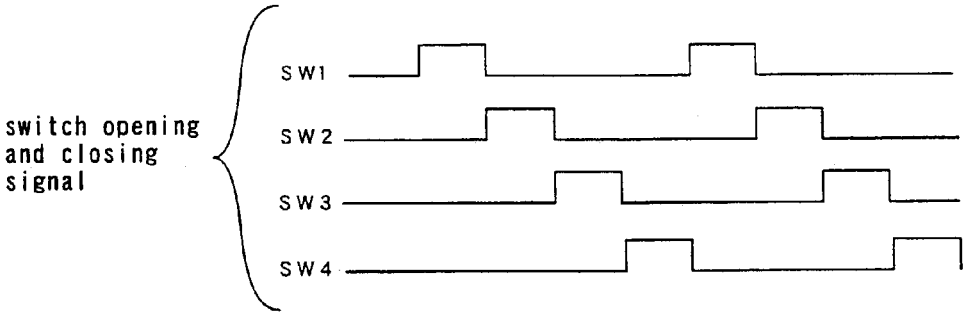

Switches SW1 to SW4 are opened and closed one by one in response to an opening and closing signal shown in a timing chart of FIG. 22B. The analog video signals are thus sampled and held in storage capacitors 2201 to 2204. The signals held are outputted through buffers 2211 to 2214. The analog data signal VA divided into four parts is thus generated.

The description given in this embodiment takes as an example the time base expansion circuit for converting an analog video signal into four parts of analog data signal VA which are associated with four source signal lines. However, the time base expansion circuit of a display device according to the present invention is not limited thereto. To elaborate, the invention can use a time base expansion circuit for converting an analog video signal into an arbitrary number of analog data signals associated with the same number of source signal lines.

This embodiment can be combined freely with Embodiments 1 through 7.

Embodiment 9

The material used in the EL layer of the EL element in the EL display of the present invention is not limited to an organic EL material, and the present invention can be implemented using an inorganic EL material. However, at present inorganic EL materials have an extremely high driver voltage, and therefore TFTs which have voltage resistance characteristics such that they are able to withstand such a high voltage must be used.

Alternately, if an inorganic EL material having a lower driver voltage is developed in the future, it is possible to apply such a material to the present invention.

Furthermore, it is possible to freely combine the constitution of Embodiment 9 with the constitution of any of Embodiments 1 to 8.

Embodiment 10

In the present invention, an organic material used as an EL layer may be either a low molecular organic material or a polymer (high molecular) organic material. As the low molecular organic material, materials are known centering on $Alq_3$ (tris-8-quinolylite-aluminum), TPD (triphenylamine derivative) or the like. As polymer organic material, π-co-operative polymer materials can be given. Typically, PPV (polyphenylenevynilene), PVK (polyvynilcarbazole), polycarbonate or the like can be given.

The polymer (high molecular) organic material can be formed with a simple thin film formation method such as the spin coating method (which is referred to also as solution application method), the dipping method, the dispense method, the printing method, the ink jet method or the like. The polymer organic material has a high heat endurance compared with the low molecular organic material.

Furthermore, in the case where the EL layer incorporated in the EL element incorporated in the EL display device according to the present invention has an electron transport layer and a positive hole transport layer, the electron transport layer and the positive hole transport layer may be formed of inorganic material such as, for example, a amorphous semiconductor formed of amorphous Si or amorphous $Si_{1-xCx}$ or the like.

In the amorphous semiconductor, a large quantity of trap level is present, and at the same time, the amorphous semiconductor forms a large quantity of interface levels at an interface at which the amorphous semiconductor contacts other layers. As a consequence, the EL element can emit light at a low voltage, and at the same time, an attempt can be made to provide a high luminance.

Besides, a dopant (impurity) is added to the organic EL layer, and the color of light emission of the organic EL layer may be changed. This dopant includes DCM1, nile red, lubren, coumarin 6, TPB and quinaquelidon.

Besides, the structure of Embodiment 10 may be combined freely with any of the structures in Embodiments 1 through 8.

Embodiment 11

Figure 13A:
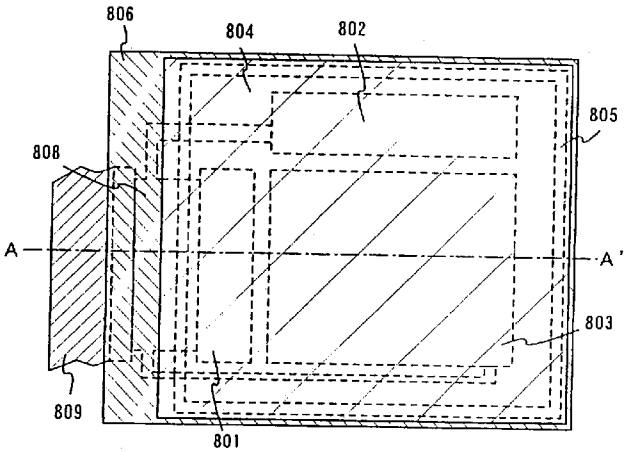
FIGS. 13A and 13B are a top view of an EL display device according to the present invention and a sectional view thereof, respectively.
Figure 13B:
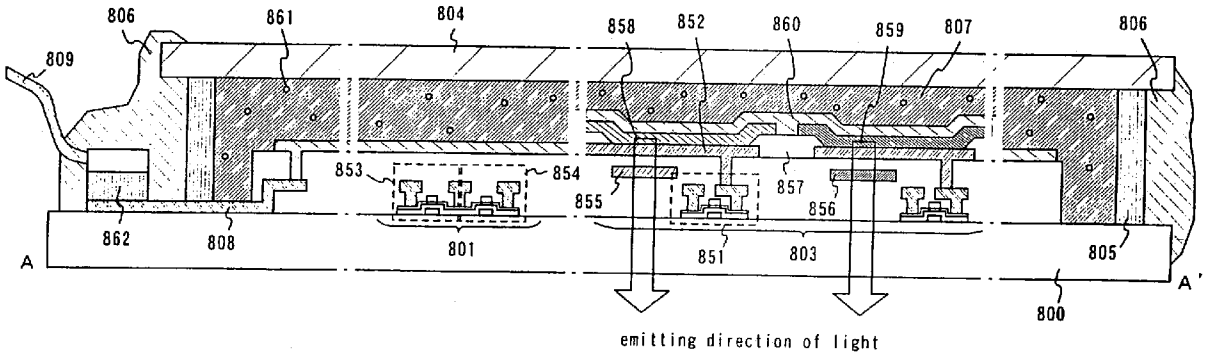

This embodiment gives a description on a case of manufacturing an EL display device in accordance with the present invention with reference to FIGS. 13A and 13B.

FIG. 13A is a top view of an active matrix substrate with an EL element formed and enclosed thereon. Regions 801, 802 and 803 sectioned by dotted lines are a source signal line driving circuit, a gate signal line driving circuit and a pixel portion, respectively. Reference symbol 804 denotes a covering member, 805, a first sealing member, and 806, a second sealing member. A filler 807 (See FIG. 13B) is provided in a space between the active matrix substrate and the covering member within the surrounding first sealing member 805.

Denoted by 808 is a connection wiring for transmitting signals to be inputted to the source signal line driving circuit 801, the gate signal line driving circuit 802 and the pixel portion 803. The wiring receives a video signal, a clock signal and the like from an FPC (flexible printed circuit) 809 that-serves as a terminal for connecting the display device with external equipment.

FIG. 13A is cut along the line A–A' and the sectional view thereof is shown in FIG. 13B. In FIGS. 13A and 13B, the same components are denoted by the same reference symbols.

As shown in FIG. 13B, the pixel portion 803 and the source signal line driving circuit 801 are formed on a substrate 800. The pixel portion 803 is comprised of a plurality of pixels each having a TFT 851 that controls the amount of current flowing into an EL element (driving TFT), a pixel electrode 852 that is electrically connected to a drain region of the TFT 851, and other components.

In this embodiment, the driving TFT 851 is a p-channel TFT. The driving TFT will be described as a representative of TFTs that constitute the pixel portion. A CMOS circuit in which an n-channel TFT 853 and a p-channel TFT 854 are combined complementarily will be described as a representative of TFTs that constitute the source signal line driving circuit 801.

Each pixel has, under the pixel electrode 852, one of a color filter (R) 855, a color filter (G) 856 and a color filter (B) (not shown). The color filter (R) is a color filter for extracting red light, the color filter (G) is a color filter for extracting green light, and the color filter (B) is a color filter for extracting blue light. The color filter (R) 855 is provided in a red light emitting pixel, the color filter (G) 856 is provided in a green light emitting pixel, and the color filter (B) is provided in a blue light emitting pixel.

The first thing given as an effect of these color filters is that the purity of emitted light is improved in terms of color. For example, the EL element of a red light emitting pixel emits red light (toward the pixel electrode side in this embodiment) and the emitted red light passes through the color filter for extracting red light to gain an improved purity of red color. The same applies to cases of green light and blue light.

In a conventional structure where a color filter is not used, visible light can enter from the outside of the EL display device to excite a light emitting layer of an EL element and to make the color of emitted light different from the desired color. On the other hand, when a color filter is used as in this embodiment, only a specific wavelength of light is allowed to enter an EL element. Thus the inconvenience of EL element being excited by external light can be avoided.

There have been proposed some structures that include using a color filter. The EL element used in these conventional cases is one that emits white light. With the EL element emitting white light, red light is extracted by cutting other wavelengths of light, which invites lowering of luminance. On the other hand, this embodiment in which red light emitted from an EL element passes through the color filter for extracting red light does not lower the luminance.

The pixel electrode 852 is formed from a transparent conductive film and functions as an anode of the EL element. An insulating film 857 is formed on each side of the pixel electrode 852, and a light emitting layer 858 for emitting red light and a light emitting layer 859 for emitting green light are further formed. Though not shown in FIG. 13, a light emitting layer for emitting blue light is formed in a pixel adjacent to the pixel having the light emitting layer 859. Thus color display is obtained by pixels emitting red light, green light and blue light. Needless to say, the pixel having the light emitting layer for emitting blue light is provided with the color filter for extracting blue light.

Other than organic materials, inorganic materials can be used as the EL material. The light emitting layer may be used in combination with one or more of an electron injection layer, an electron transportation layer, a hole transportation layer and a hole injection layer to form a laminate.

A cathode 860 of the EL element is formed on the light emitting layers from a light-shielding conductive film. The cathode 860 is shared by all the pixels, and is electrically connected to the FPC 809 through the connection wiring 808.

Then the first sealing member 805 is formed using a dispenser or the like, a spacer (not shown) is sprayed, and the covering member 804 is bonded. The filler 807 is filled into a region surrounded by the active matrix substrate, the covering member 804 and the first sealing member 805 by vacuum injection.

In this embodiment, the filler 807 is doped in advance with barium oxide as a hygroscopic substance 861. Although the filler is doped with the hygroscopic substance in this embodiment, it may be contained in the filler in chunks dispersed throughout the filler. Alternatively, though not shown, the hygroscopic substance may be used as a material for the spacer.

The filler 807 is then cured by irradiation of ultraviolet light or by heating. Thereafter, an opening (not shown) formed in the first sealing member 805 is closed. After closing the opening in the first sealing member 805, the connection wiring 808 is electrically connected to the FPC 809 with a conductive material 862. The second sealing member 806 is placed so as to cover the exposed portion of the first sealing member 805 and a part of the FPC 809. The second sealing member 806 can be formed from the same material as the first sealing member 805.

The EL element is enclosed in the filler 807 in accordance with the method described above, whereby the EL element is completely shut out from the outside and moisture and substances promoting oxidation of the organic material, such as oxygen, can be prevented from entering the EL element from the outside. Thus an EL display device of high reliability can be manufactured.

This embodiment can be combined freely with Embodiments 1 through 10.

Embodiment 12

Figure 14:
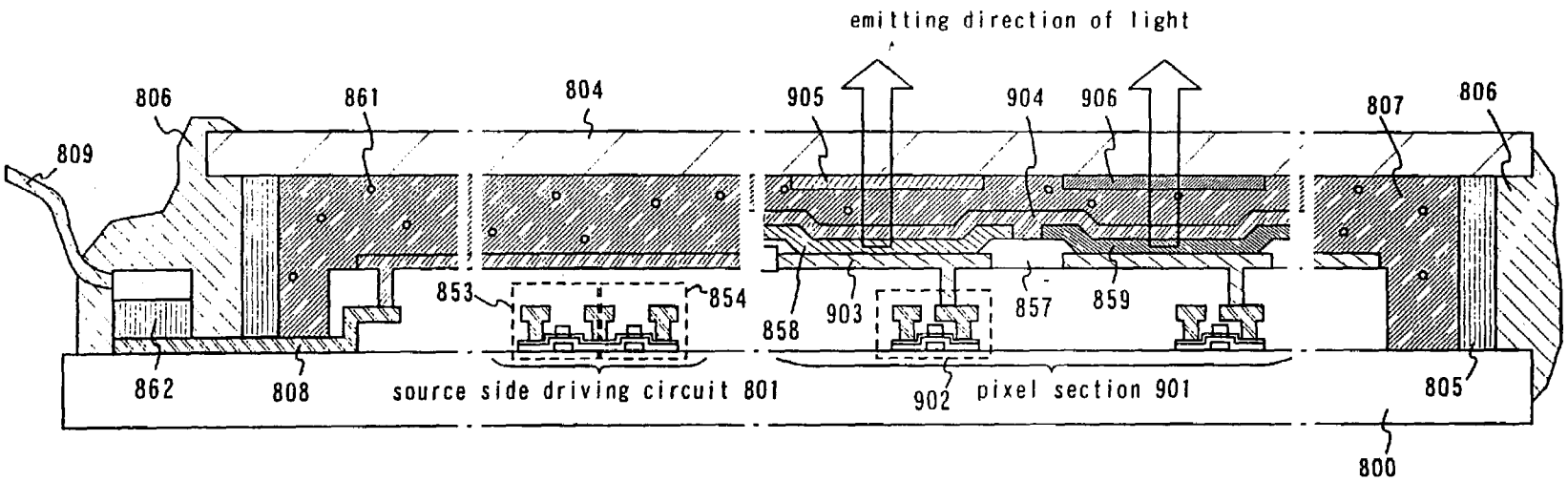
FIG. 14 is a sectional view of an EL display device according to the present invention.

This embodiment shows an example of the case where the traveling direction of the light emitted from the EL element and arrangement of the color filters are different from those of the EL display device shown in Embodiment 11. The description will be given with reference to FIG. 14. The basic structure of FIG. 14 is the same as FIG. 13, and only modified components receive new reference symbols and description.

A pixel portion 901 is comprised of a plurality of pixels each having a TFT 902 that controls the amount of current flowing into the EL element (driving TFT), a pixel electrode 903 that is electrically connected to a drain region of the TFT 902, and other components.

In this embodiment, an n-channel TFT is used for the driving TFT 902 in the pixel portion 901. The drain of the driving TFT 902 is electrically connected to the pixel electrode 903, which is formed from a light-shielding conductive film. The pixel electrode 903 serves as a cathode of the EL element in this embodiment.

On the light emitting layer 858 for emitting red light and the light emitting layer 859 for emitting green light, a transparent conductive film 904 shared by the pixels are formed. The transparent conductive film 904 serves as an anode of the EL element.

Another feature of this embodiment is that a color filter (R) 905, a color filter (G) 906 and a color filter (B) (not shown) are formed in the covering member 804. With an EL element having the structure of this embodiment, light emitted from the light emitting layers travels toward the covering member side. Therefore the color filters can be placed in that path of the light in the structure of FIG. 14.

Forming the color filter (R) 905, the color filter (G) 906 and the color filter (B) (not shown) in the covering member 804 as in this embodiment is advantageous, for the steps of manufacturing an active matrix substrate can be reduced in number to thereby improve the yield and the throughput.

This embodiment can be combined freely with Embodiments 1 through 10.

Embodiment 13

This embodiment describes a case of actually constructing from elements the constant current generator of the temperature compensation circuit which has the structure shown in FIG. 1 in accordance with Embodiment Mode 1.

Figure 23:
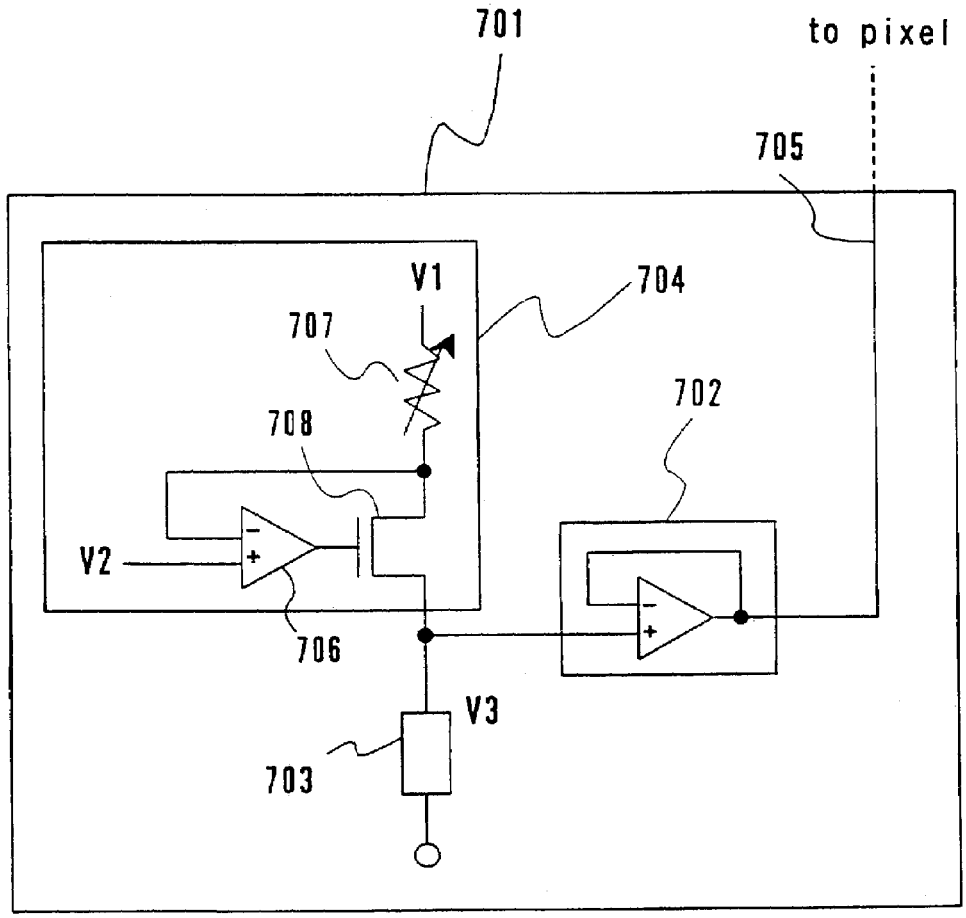
FIG. 23 is a diagram showing the structure of a constant current generator in a temperature compensation circuit of an EL display device according to the present invention.

FIG. 23 is a circuit diagram showing the structure of the temperature compensation circuit according to this embodiment.

In FIG. 23, a temperature compensation circuit 701 is composed of a constant current generator 704, a monitoring EL element 703 and a buffer amplifier 702.

An output of the constant current generator 704 is connected to one electrode of the monitoring EL element 703 and to an input terminal of the buffer amplifier 702. An output of the buffer amplifier 702 serves as an output of the temperature compensation circuit 701.

The output of the temperature compensation circuit 701 is connected to a power supply line 705, which gives an electric potential to a pixel electrode of an EL element (not shown) in a pixel through the source-drain of a driving TFT (not shown).

The constant current generator 704 is composed of an amplifier 706, a variable resister 707 and a transistor 708.

The transistor 708 is a p-channel TFT in the description given in this embodiment but the transistor is not limited thereto. The polarity of this transistor may be of an n-channel TFT or of a p-channel TFT. Alternatively, the transistor may be a bipolar transistor.

The transistor 708 has a source region connected to an inversion input terminal (−) of the amplifier 706 and to the variable resister 707, and has a drain region connected to an output terminal of the constant current generator 704. A gate electrode of the transistor 708 is connected to an output terminal of the amplifier 706.

A constant voltage V2 is inputted to a non-inversion terminal (+) of the amplifier 706.

The amplifier 706, the variable resister 707 and the transistor 708 that constitute the constant current generator may be formed on an IC chip or on the same substrate which has an insulating surface and on which pixels are formed.

The monitoring EL element 703 connected to the constant current generator 701 operates so as to cause a constant current generated by the constant current generator 701 to flow. If there is a change in surrounding temperature while the display device is in use, the amount of current flowing through the monitoring EL element 703 does not change. Instead, the electric potential of the electrode of the monitoring EL element which is connected to the constant current generator 704 is changed.

The monitoring EL element 703 and an EL element in a pixel are manufactured such that the relation of the amount of current flowing into the element to the level of voltage applied between two electrodes of the element is the same for both the monitoring EL element 703 and the pixel EL element at the same temperature.

The electric potential of an electrode of the monitoring EL element 703 which is not connected to the constant current generator 704 and to a non-inversion input terminal of the buffer amplifier 702 is set to the same level as the electric potential of an opposite electrode of the EL element in each pixel.

In the temperature compensation circuit, an electrode of a pixel EL element (pixel electrode) which is connected to the output terminal of the buffer amplifier has to be an anode if the electrode of the monitoring EL element which is connected to the output of the buffer amplifier and to the constant current generator is an anode. On the other hand, in the temperature compensation circuit, the electrode of the pixel EL element (pixel electrode) which is connected to the output terminal of the buffer amplifier has to be a cathode if the electrode of the monitoring EL element which is connected to the output of the buffer amplifier and to the constant current generator is a cathode.

A case in which the anode of the monitoring EL element is connected to the constant current generator 704 and the buffer amplifier 702 is considered here in this embodiment. In this case, the pixel electrode of the pixel EL element is an anode.

In order to cause a current to flow into the monitoring EL element, an electric potential V1 is set to a level higher than an input electric potential V2. The electric potential V1 is the electric potential of the terminal of the variable resister 707 which is not connected to the transistor 708 and to the non-inversion input terminal of the amplifier 706. The input electric potential V2 is the electric potential inputted to the non-inversion input terminal of the amplifier 706. An electric potential V3 of the anode of the monitoring EL element 703 is set to a level lower than the electric potential V2.

When the electric potential V3 of the anode of the monitoring EL element 703 is changed to change the voltage between the two electrodes thereof, the electric potential of the anode of the pixel EL element is similarly changed to change the voltage between the two electrodes thereof. This change in voltage works to cause a constant current provided by the constant current generator 704 at the surrounding temperature to flow also into the pixel portion EL element. In this way, the pixel portion EL element receives a constant current irrespective of a change in surrounding temperature and emits light of constant luminance.

The structure of the constant current generator is not limited to the structure of 704, but a constant current generator circuit of any known structure can be employed without restriction.

This embodiment can be combined freely with Embodiments 1 through 12.

Embodiment 14

This embodiment shows results of measuring a change in luminance of a pixel EL element in a display device of the present invention which is caused by a change in temperature.

Figure 24:
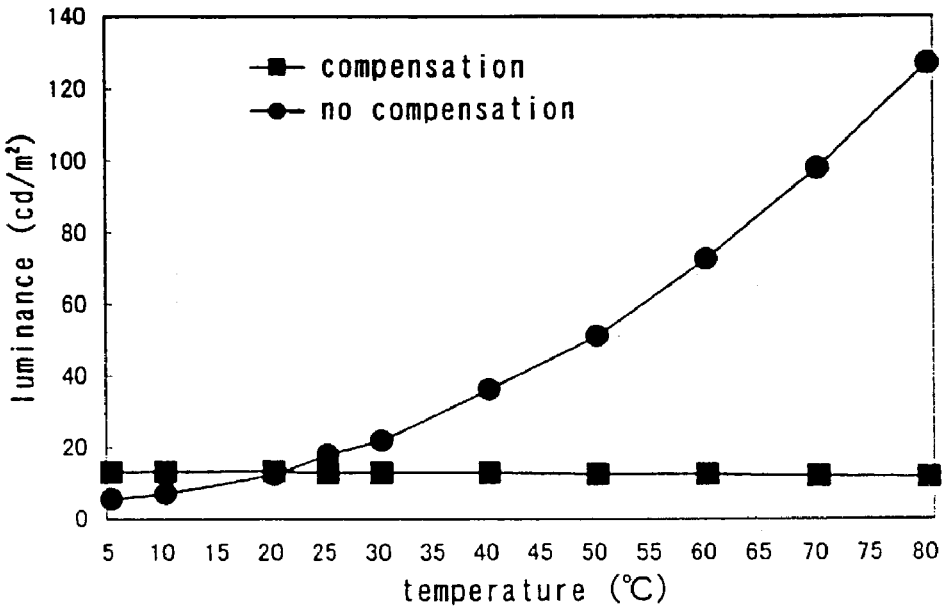
FIG. 24 is a graph showing changes in luminance of an EL display device of the present invention which is caused by changes in temperature.

FIG. 24 is a graph showing the measurement results. In the graph, the axis of ordinate shows the luminance (cd/m$^2$) and the axis of abscissa shows the temperature (° C.).

The results shown are of the case where the temperature compensation circuit structured as shown in FIG. 23 is used.

The graph also shows results of measuring a change in luminance of a pixel EL element due to a temperature change in a display device that does not have a temperature compensation circuit.

In the case where no temperature compensation circuit is provided, the luminance of an EL element is increased as the temperature rises. On the other hand, in the case of using the temperature compensation circuit, the luminance of an EL element is almost constant irrespective of the temperature.

The present invention thus can prevent the change in luminance of a pixel portion EL element in a display device due to a temperature change by using a temperature compensation circuit.

The invention is also advantageous in the following point. The EL layer constituting the EL element is formed mainly from organic compounds and degradation thereof is a problem required to be solved. Comparing the case in which a pixel EL element emits light upon receiving a constant current flowing between the electrodes of the element with the case in which a pixel EL element emits light upon receiving a constant voltage applied between the electrodes of the element, lowering of luminance due to the degradation of EL element is less in the former case. Therefore inputting a constant current into a pixel EL element in order to cause the element to emit light as in this embodiment is capable of limiting the lowering of luminance due to the degradation of its EL layer.

Thus can be obtained a display device in which the luminance of a pixel EL element is not changed by a change in surrounding temperature and the luminance is lowered less when the EL element is degraded.

Embodiment 15

The EL display device manufactured by applying the present invention can be used in various kinds of electronic equipment. The electronic equipment, which incorporates the EL display device manufactured by applying the present invention as the display medium, are explained below.

Such kind of electronic equipment include personal computer, a portable information medium (such as a mobile computer, mobile telephone, a electronic book and so forth), a game machine, a TV receiver, a video camera, a digital camera, a telephone, a head mounted display (goggle type display), an image playback device, a car navigation system and the like. Examples of those are shown in FIG. 9.

Figure 25A:
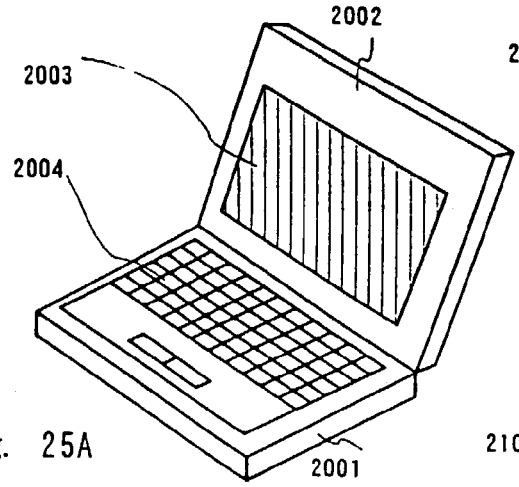

FIG. 25A shows a personal computer, which contains a main body 2001, a casing 2002, a display portion 2003, a keyboard 2004 and the like. The EL display device of the present invention can be used in the display portion 2003 of the personal computer.

Figure 25B:
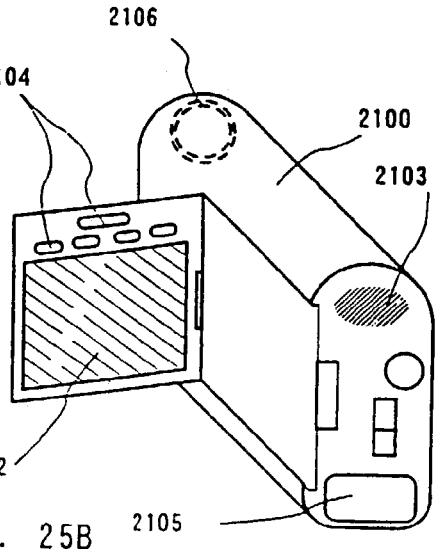

FIG. 25B shows a video camera, which contains a main body 2100, a display portion 2102, a sound input portion 2103, operation switches 2104, a battery 2105, an image receiving portion 2106 and the like. The EL display device of the present invention can be used in the display portion 2102 of the video camera.

Figure 25C:
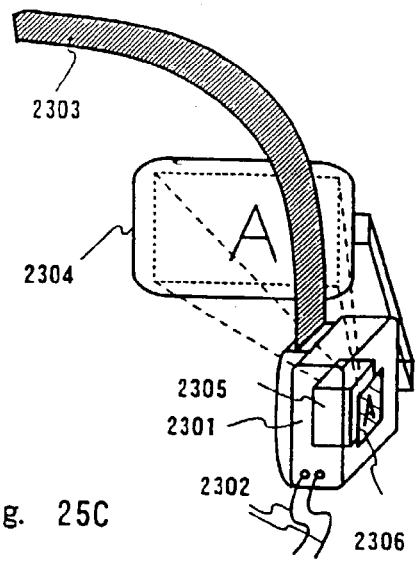

FIG. 25C shows a portion (right side) of a head mounted display, which contains a main body 2301, a signal cable 2302, a head fixing band 2303, a screen monitor 2304, an optical system 2305, a display portion 2306 and the like. The EL display device of the present invention can be used in the display portion 2306 of the head mounted display.

Figure 25D:
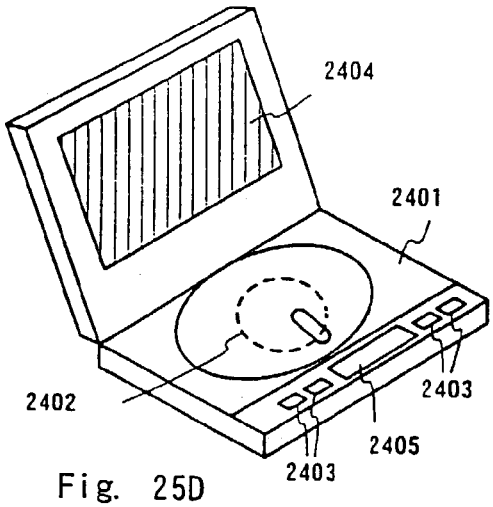

FIG. 25D shows an image playback device equipped with a recording medium (specifically, a DVD playback device), which contains a main body 2401, a recording medium (such as a CD, an LD or a DVD) 2402, operation switches 2403, a display portion (a) 2404, a display portion (b) 2405 and the like. The display portion (a) 2404 is mainly used for displaying image information. The display portion (b) 2405 is mainly used for displaying character information. The EL display device of the present invention can be used in the display portion (a) 2404 and the display portion (b) 2405 of the image playback device equipped with the recording medium. Note that the present invention can be applied to devices such as a CD playback device and a game machine as the image playback device equipped with the recording medium.

Figure 25E:
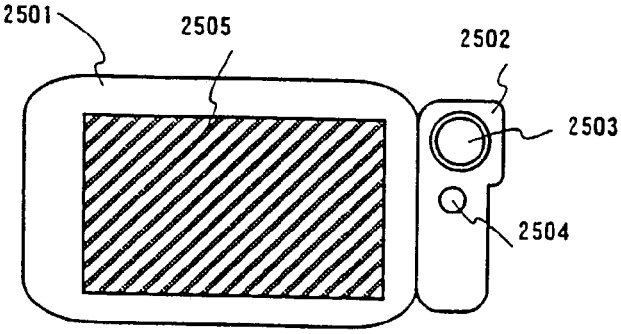

FIG. 25E shows a mobile computer, which contains a main body 2501, a camera portion 2502, an image receiving portion 2503, operation switches 2504, a display portion 2505 and the like. The EL display device of the present invention can be used in the display portion 2505 of the mobile computer.

Further, if the emission luminance of an EL material is improved in future, the EL material may be used in a front type or rear type projector.

The electronic equipment of this embodiment can be realized using the constitution in which Embodiments 1 to 14 are freely combined.

Conventional EL display devices have problems such as fluctuation in luminance and increased current consumption, for the amount of current flowing into an EL element is changed by a change in surrounding temperature while the devices are in use depending on the temperature characteristic of the EL element even if the voltage applied to the EL element is the same.

Also, a source signal line driving circuit composed of a bottom gate TFT is a hindrance for a display device to obtain a larger screen and more gray scales because of its poor frequency characteristic and resulting slow operation.

The present invention employs the above structures to keep the amount of current flowing into a pixel portion EL element constant against a change in temperature. The invention also gives a margin to sampling of a video signal in the source signal line driving circuit by subjecting the video signal to time base expansion.

In this way, the invention can provide a display device which can prevent the change in luminance and increase in current consumption of the EL element due to a change in surrounding temperature and which can obtain a larger screen, higher definition and more gray scales by compensating the frequency characteristic of a source signal line driving circuit that is composed of a bottom gate TFT.

What is claimed is:

1. An active matrix EL display device comprising:
- a plurality of pixels each having a thin film transistor connected to an EL element;
- a constant current generator;
- a monitoring EL element for monitoring a change in amount of current flowing into the EL element of a pixel, wherein the monitoring EL element has at least a first electrode, a second electrode and an EL layer between the first electrode and the second electrode; and
- a buffer amplifier having a non-inversed input terminal, an inversed input terminal and an output terminal,
- wherein the EL element of a pixel is electrically connected to the output terminal of the buffer amplifier, and
- wherein the non-inversed input terminal of the buffer amplifier is electrically connected to the first electrode of the monitoring EL element.

2. An active matrix EL display device according to claim 1, wherein the at least one of the constant current generator and the buffer amplifier is composed of a thin film transistor.

3. An active matrix EL display device according to claim 1, wherein the first electrode is a cathode and the second electrode is an anode.

4. An active matrix EL display device according to claim 1, wherein the EL layer comprise at least an organic EL material.

5. An active matrix EL display device according to claim 1, wherein the active matrix EL display device is incorporated into an electronic equipment selected from the group consisting of a personal computer, a video camera, a head mounted display, an image playback device and a mobile computer.

6. An active matrix EL display device comprising:
- a constant current generator;
- a monitoring EL element having at least a first electrode, a second electrode and an EL layer between the first electrode and the second electrode;
- a buffer amplifier having a non-inversed input terminal, an inversed input terminal and an output terminal;
- a plurality of pixels in a pixel portion, wherein each of the plurality of pixels has a thin film transistor electrically connected to an EL element; and
- a power supply line for supplying a voltage to the plurality of pixels,
- wherein the non-inversed input terminal of the buffer amplifier is electrically connected to the first electrode of the monitoring EL element,
- wherein the EL element of a pixel is electrically connected to the output terminal of the buffer amplifier via the power supply line, and
- wherein the monitoring EL element is formed separately from the pixel portion and monitors a change in amount of current flowing into the EL element of a pixel.

7. An active matrix EL display device according to claim 6, wherein the at least one of the constant current generator and the buffer amplifier is composed of a thin film transistor.

8. An active matrix EL display device according to claim 6, wherein the first electrode is a cathode and the second electrode is an anode.

9. An active matrix EL display device according to claim 6, wherein the EL layer comprise at least an organic EL material.

10. An active matrix EL display device according to claim 6, wherein the active matrix EL display device is incorporated into an electronic equipment selected from the group consisting of a personal computer, a video camera, a head mounted display, an image playback device and a mobile computer.

11. An active matrix EL display device comprising:
- a plurality of pixels each having a thin film transistor electrically connected to an EL element;
- a constant current generator;
- a monitoring EL element for monitoring a change in amount of current flowing into the EL element of a pixel, wherein the monitoring EL element has at least a first electrode, a second electrode and an EL layer between the first electrode and the second electrode;
- a buffer amplifier having a non-inversed input terminal, an inversed input terminal and an output terminal; and
- an adder circuit having an input terminal and an output terminal,
- wherein the non-inversed input terminal of the buffer amplifier is electrically connected to the first electrode of the monitoring EL element,
- wherein the input terminal of the adder circuit is electrically connected to the output terminal of the buffer amplifier, and
- wherein the output terminal of the adder circuit is electrically connected to the EL element of a pixel.

12. An active matrix EL display device according to claim 11, wherein the at least one of the constant current generator and the buffer amplifier is composed of a thin film transistor.

13. An active matrix EL display device according to claim 11, wherein the first electrode is a cathode and the second electrode is an anode.

14. An active matrix EL display device according to claim 11, wherein the EL layer comprise at least an organic EL material.

15. An active matrix EL display device according to claim 11, wherein the active matrix EL display device is incorporated into an electronic equipment selected from the group consisting of a personal computer, a video camera, a head mounted display, an image playback device and a mobile computer.

16. An active matrix EL display device comprising:

a plurality of pixels each having a thin film transistor electrically connected to an EL element;

a constant current generator;

a monitoring EL element having a first electrode, a second electrode and an EL layer between the first electrode and the second electrode;

a buffer amplifier having a non-inversed input terminal, an inversed input terminal and an output terminal; and an adder circuit having an input terminal and an output terminal, wherein the non-inversed input terminal of the buffer amplifier is electrically connected to the first electrode of the monitoring EL element, wherein the input terminal of the adder circuit is electrically connected to the output terminal of the buffer amplifier, wherein the output terminal of the adder circuit is electrically connected to the EL element of a pixel, and wherein the adder circuit comprises a non-inversion amplifier circuit.

17. An active matrix EL display device according to claim 16, wherein the at least one of the constant current generator and the buffer amplifier is composed of a thin film transistor.

18. An active matrix EL display device according to claim 16, wherein the first electrode is a cathode and the second electrode is an anode.

19. An active matrix EL display device according to claim 16, wherein the EL layer comprise at least an organic EL material.

20. An active matrix EL display device according to claim 16, wherein the active matrix EL display device is incorporated into an electronic equipment selected from the group consisting of a personal computer, a video camera, a head mounted display, an image playback device and a mobile computer.

21. An active matrix EL display device comprising:

a constant current generator;

a monitoring EL element having a first electrode, a second electrode and an EL layer between the first electrode and the second electrode;

a buffer amplifier having a non-inversed input terminal, an inversed input terminal and an output terminal;

a power supply line for supplying a voltage to the plurality of pixels, an adder circuit having an input terminal and an output terminal; and a plurality of pixels in a pixel portion, wherein each of the plurality of pixels has a thin film transistor electrically connected to an EL element, wherein the non-inversed input terminal of the buffer amplifier is electrically connected to the first electrode of the monitoring EL element, wherein the input terminal of the adder circuit is electrically connected to the output terminal of the buffer amplifier, wherein the EL element of a pixel is electrically connected to the output terminal of the adder circuit via the power supply line, and wherein the monitoring EL element is formed separately from the pixel portion and monitors a change in amount of current flowing into the EL element of a pixel.

22. An active matrix EL display device according to claim 21, wherein the at least one of the constant current generator and the buffer amplifier is composed of a thin film transistor.

23. An active matrix EL display device according to claim 21, wherein the first electrode is a cathode and the second electrode is an anode.

24. An active matrix EL display device according to claim 21, wherein the EL layer comprise at least an organic EL material.

25. An active matrix EL display device according to claim 21, wherein the active matrix EL display device is incorporated into an electronic equipment selected from the group consisting of a personal computer, a video camera, a head mounted display, an image playback device and a mobile computer.

26. The active matrix EL display device according claim 1, wherein the change in amount of current flowing into the EL element of a pixel is due to a temperature change.

27. The active matrix EL display device according claim 6, wherein the change in amount of current flowing into the EL element of a pixel is due to a temperature change.

28. The active matrix EL display device according claim 11, wherein the change in amount of current flowing into the EL element of a pixel is due to a temperature change.

29. The active matrix EL display device according claim 21, wherein the change in amount of current flowing into the EL element of a pixel is due to a temperature change.

* * * * *